US008113640B2

(12) United States Patent
Shimizu

(10) Patent No.: US 8,113,640 B2
(45) Date of Patent: Feb. 14, 2012

(54) LIQUID DROPLET DISCHARGING APPARATUSES AND LIQUID CARTRIDGES

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 406 days.

(21) Appl. No.: 12/404,217

(22) Filed: Mar. 13, 2009

(65) Prior Publication Data

US 2009/0244221 A1 Oct. 1, 2009

(30) Foreign Application Priority Data

Mar. 27, 2008 (JP) ..... 2008-082999

(51) Int. Cl.
*B41J 2/175* (2006.01)

(52) U.S. Cl. ..... 347/86; 347/84

(58) Field of Classification Search ..... 347/84–86
See application file for complete search history.

(56) References Cited

U.S. PATENT DOCUMENTS

| | | | | |
|---|---|---|---|---|
| 7,125,108 | B2 | 10/2006 | Toba et al. | |
| 7,147,309 | B2 | 12/2006 | Sakai et al. | |
| 7,222,949 | B2 | 5/2007 | Ichihashi et al. | |
| 7,249,832 | B2 | 7/2007 | Sakai et al. | |
| 7,278,722 | B2 | 10/2007 | Sasaki et al. | |
| 7,328,987 | B2 * | 2/2008 | Katayama et al. | 347/86 |
| 7,354,143 | B2 * | 4/2008 | Nishida et al. | 347/85 |
| 7,887,168 | B2 * | 2/2011 | Shimizu et al. | 347/85 |
| 2005/0024451 | A1 | 2/2005 | Steinmetz et al. | |
| 2005/0068391 | A1 | 3/2005 | Inoue et al. | |
| 2005/0088497 | A1 * | 4/2005 | Katayama et al. | 347/86 |
| 2006/0001715 | A1 * | 1/2006 | Umeda et al. | 347/86 |
| 2007/0070143 | A1 | 3/2007 | Hattori et al. | |
| 2007/0285474 | A1 * | 12/2007 | Murakami | 347/85 |

(Continued)

FOREIGN PATENT DOCUMENTS

JP 2005-103856 A 4/2005

(Continued)

OTHER PUBLICATIONS

Machine translation of JP 2005231220.*

(Continued)

*Primary Examiner* — Stephen Meier
*Assistant Examiner* — Sharon A Polk
(74) *Attorney, Agent, or Firm* — Baker Botts L.L.P.

(57) ABSTRACT

A liquid cartridge has a liquid chamber configured to store liquid, and a liquid supply opening configured to supply liquid from an interior of the liquid chamber to an exterior of the liquid chamber. A first closing mechanism is configured to selectively cover and uncover the liquid supply opening. An air communication opening formed in the liquid cartridge is configured to place the interior of the liquid chamber in communication with an exterior of the chamber, in order to equalize a pressure in the liquid chamber with an atmospheric pressure. A second closing mechanism is configured to selectively cover and uncover the air communication opening. When the liquid cartridge is mounted to a cartridge mounting portion of a liquid discharging apparatus, a damper located in one of the liquid cartridge and the cartridge mounting portion is configured to oppose at least a portion of a mounting force applied to the liquid cartridge. During the mounting of the liquid cartridge to the cartridge mounting portion, the first closing mechanism and the second closing mechanism are configured, such that the air communication opening is uncovered before the liquid supply opening is uncovered.

14 Claims, 17 Drawing Sheets

U.S. PATENT DOCUMENTS

2008/0231676 A1* 9/2008 Shimizu ..... 347/86

FOREIGN PATENT DOCUMENTS

| | | | |
|---|---|---|---|
| JP | 2005-144680 | A | 6/2005 |
| JP | 2005-231220 | A | 9/2005 |
| JP | 2007-015408 | A | 1/2007 |
| JP | 2007-500619 | T | 1/2007 |
| JP | 2007-144804 | A | 6/2007 |

OTHER PUBLICATIONS

Machine translation of JP 2005103856.*

Japan Patent Office; Notice of Reasons for Rejection in Japanese Patent Application No. 2008-082999 (counterpart to the above-captioned U.S. patent application) mailed Apr. 20, 2010.

* cited by examiner

LIQUID DROPLET DISCHARGING APPARATUSES AND LIQUID CARTRIDGES

CROSS-REFERENCE TO RELATED APPLICATION

The present application claims priority from Japanese Patent Application No. JP-2008-82999, which was filed on Mar. 27, 2008, the disclosure of which is incorporated herein by reference in its entirety.

BACKGROUND OF THE INVENTION

1. Field of the Invention

The invention relates to liquid droplet discharging apparatuses, e.g., ink-jet printers, and liquid cartridges, e.g., ink cartridges, to be used with liquid droplet discharging apparatuses.

2. Description of Related Art

In a known ink-jet printer, ink is supplied from an ink cartridge to a discharging head and then discharged from a plurality of nozzles formed in the discharging head, such that an image is printed on a sheet of paper. When gas is dissolved in ink in the ink cartridge, the gas may form gas bubbles, and the gas bubbles may be supplied to the discharging head together with ink. As a consequence, the gas bubbles may cause a discharge failure in the nozzles, thereby lowering the printing quality. In order to prevent gas bubbles from forming, when the ink cartridge is manufactured, gas dissolved in the ink is discharged to an exterior of the ink cartridge by depressurizing an ink chamber of the ink cartridge, such that the pressure of the ink chamber is less than the atmospheric pressure. The ink cartridge is packed and shipped in this depressurized state. A similar method is described in JP-A-2007-144804, for example.

When an ink cartridge is mounted to an ink-jet printer, if the ink chamber is brought into communication with the discharging head while the ink chamber is still in a depressurized state, a reverse flow of ink from the discharging head toward the ink cartridge may occur, and air may enter the discharging head through the nozzles. As a result, menisci of ink formed in the nozzles of the discharging head are destroyed, and ink no longer may be discharged stably. To prevent this, the ink cartridge has an air communication valve, in addition to an ink supply valve. When opened, the air communication valve permits the pressure of the interior of the ink chamber to equalize with the atmospheric pressure. During a mounting operation, when the ink cartridge is mounted to the printer, the air communication valve is opened before the ink supply valve is opened, in order to equalize the pressure and prevent a reverse flow of ink from the discharging head toward the ink cartridge.

Nevertheless, when a user mounts the ink cartridge to the printer quickly, the period of time between opening the air communication valve and opening the ink supply valve may be short, and the pressure of the ink chamber may not have sufficient time to equalize with the atmospheric pressure. Hence, the ink chamber may be brought into communication with the discharging head before the pressure in the ink chamber reaches the atmospheric pressure. Accordingly, the menisci of ink formed in the nozzles of the discharging head may be destroyed, and ink no longer may be discharged stably.

SUMMARY OF THE INVENTION

Therefore, a need has arisen for liquid droplet discharging apparatuses and liquid cartridges that overcome these and other shortcomings of the related art. A technical advantage of the invention is that pressure in a liquid chamber of a liquid cartridge may reach the atmospheric pressure, or a pressure close to the atmospheric pressure, before the liquid chamber is brought into communication with a discharging head of a liquid droplet discharging apparatus, even when a user mounts the liquid cartridge to the liquid droplet discharging apparatus quickly.

According to an embodiment of the invention, a liquid cartridge has a liquid chamber configured to store liquid, and a liquid supply opening configured to supply liquid from an interior of the liquid chamber to an exterior of the liquid chamber. A first closing mechanism is configured to selectively cover and uncover the liquid supply opening. An air communication opening formed in the liquid cartridge is configured to place the interior of the liquid chamber in communication with an exterior of the chamber, in order to equalize a pressure in the liquid chamber with an atmospheric pressure. A second closing mechanism is configured to selectively cover and uncover the air communication opening. When the liquid cartridge is mounted to a cartridge mounting portion of a liquid discharging apparatus, a damper located in one of the liquid cartridge and the cartridge mounting portion is configured to oppose at least a portion of a mounting force applied to the liquid cartridge. During the mounting of the liquid cartridge to the cartridge mounting portion, the first closing mechanism and the second closing mechanism are configured, such that the air communication opening is uncovered before the liquid supply opening is uncovered.

According to another embodiment of the invention, a liquid cartridge has a liquid chamber configured to store liquid, and a liquid supply opening configured to supply liquid from an interior of the liquid chamber to an exterior of the liquid chamber. A first closing mechanism is configured to selectively cover and uncover the liquid supply opening. An air communication opening formed in the liquid cartridge is configured to place the interior of the liquid chamber in communication with an exterior of the chamber, in order to equalize a pressure in the liquid chamber with an atmospheric pressure. A second closing mechanism is configured to selectively cover and uncover the air communication opening. The liquid cartridge comprises a damper configured to oppose at least a portion of a force applied to the liquid cartridge during a mounting operation by creating a resistance.

Other objects, features, and advantages of embodiments of the invention will be apparent to persons of ordinary skill in the art from the following description of embodiments with reference to the accompanying drawings.

BRIEF DESCRIPTION OF DRAWINGS

For a more complete understanding of the invention, the needs satisfied thereby, and the objects, features, and advantages thereof, reference now is made to the following description taken in connection with the accompanying drawings.

DETAILED DESCRIPTION OF THE EXEMPLARY EMBODIMENTS

Embodiments of the invention and their features and technical advantages may be understood by referring to FIGS. 1-17, like numerals being used for like corresponding portions in the various drawings.

Figure 1:
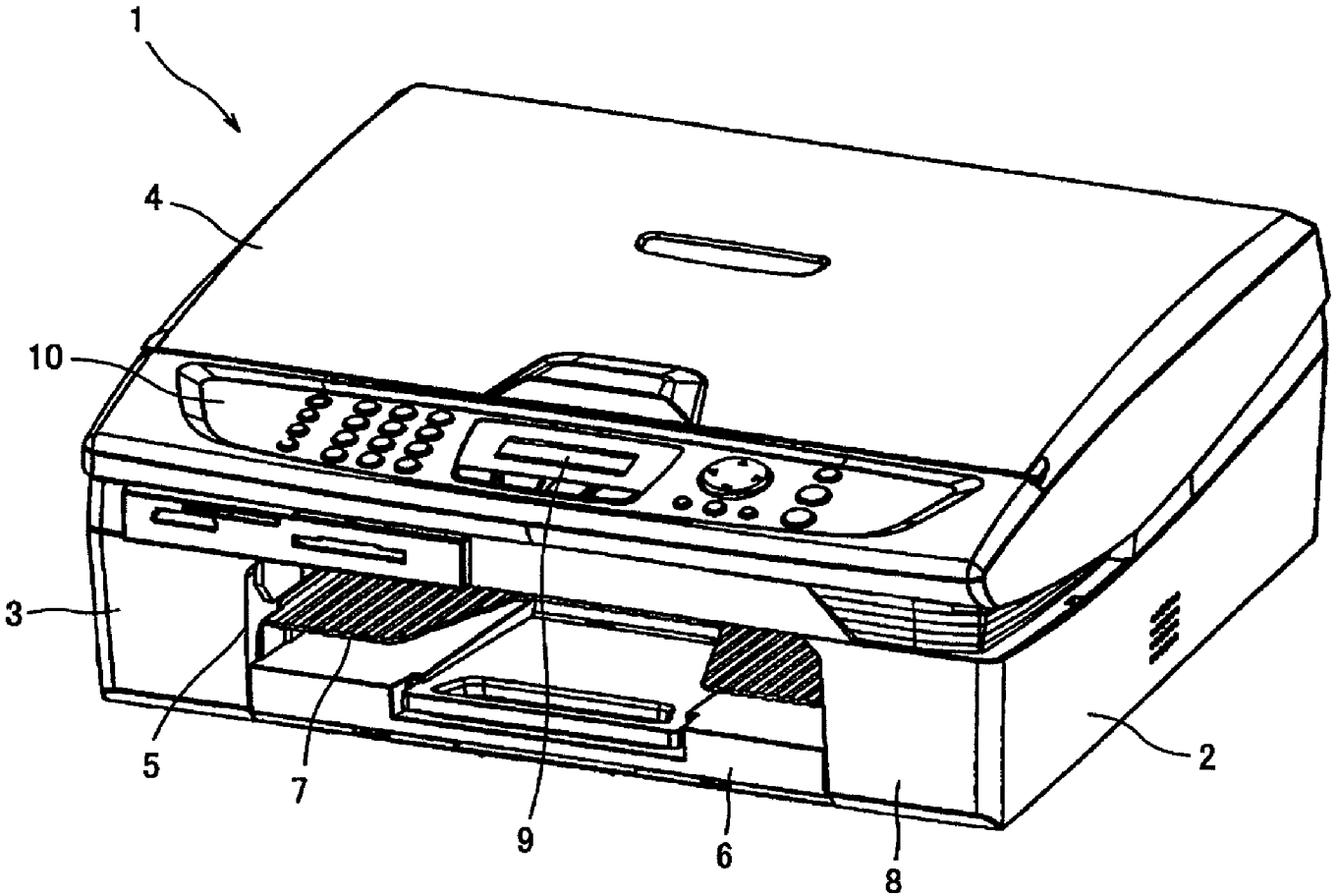
FIG. 1 is a perspective view of a multifunction device comprising an ink-jet printer according to an embodiment of the invention.

Referring to FIG. 1, a multifunction device 1 according to an embodiment of the invention may have a printer function, a scanner function, a copying function, and a facsimile function, and may comprise an ink-jet printer 3 in the lower portion of a body 2 of multifunction device 1, and a scanner 4 at the top portion of body 2. An opening 5 may be formed through the front of body 2. Ink-jet printer 3 may comprise a paper feed tray 6 and a paper discharge tray 7 positioned above paper feed tray. Paper feed tray 6 and paper discharge tray 7 may be removed via opening 5. Multifunction device 1 may comprise a cover 8 at the front lower right portion of body 2, and ink-jet printer 3 may comprise a cartridge mounting portion 19 in the front lower right portion of body 2. When cover 8 is opened, cartridge mounting portion 19 may be exposed to an exterior of body 2. Multifunction device 1 may comprise an operation panel 10 having buttons for inputting instruction for operating ink-jet printer 3, scanner 4 and the like, and a display device 9, on the upper front portion of body 2. Multifunction device 1 may be operable by instruction from an external personal computer (not shown).

Figure 2:
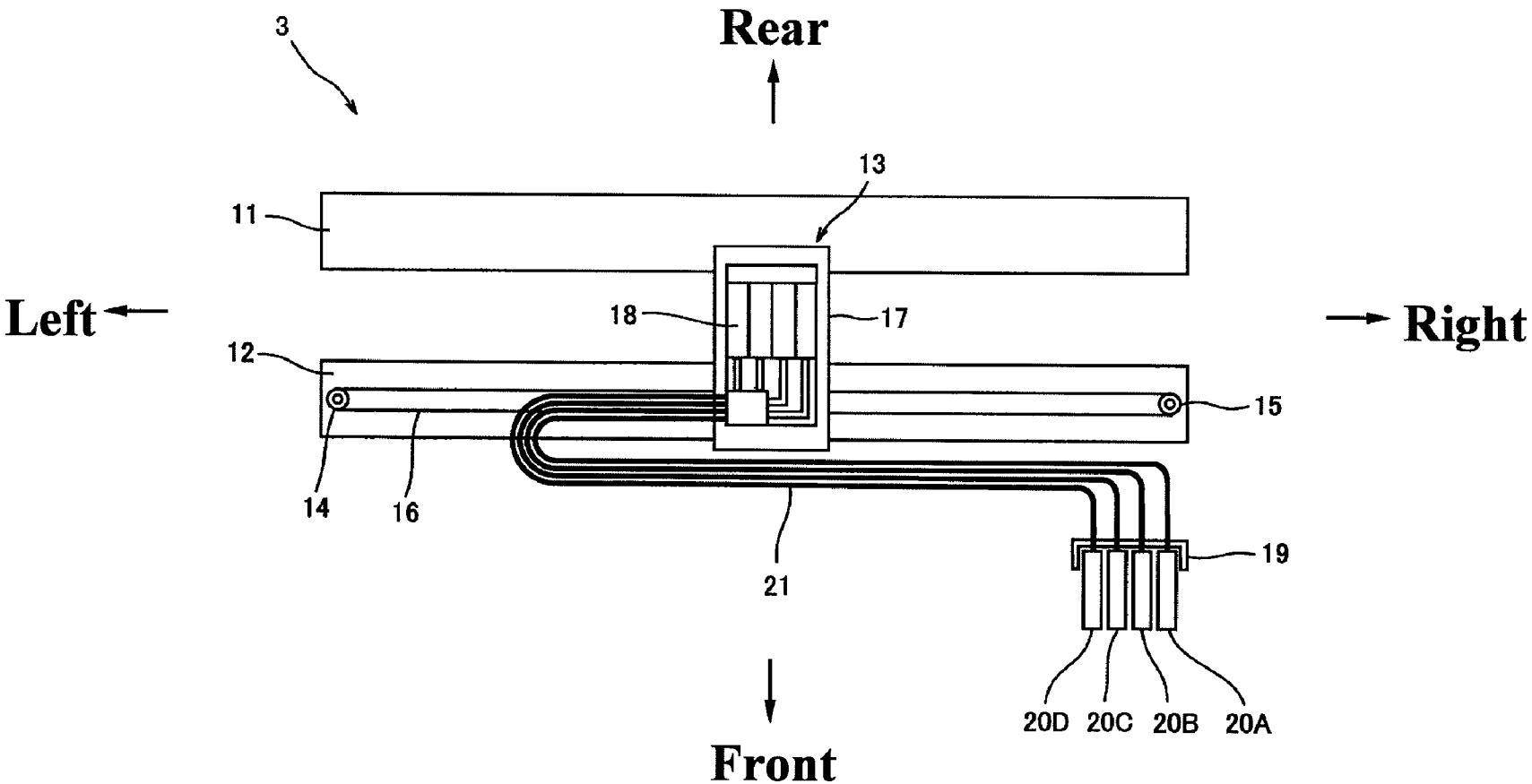
FIG. 2 is a schematic plan view of the ink-jet printer of FIG. 1.

Referring to FIG. 2, ink-jet printer 3 may comprise a pair of guide rails 11, 12 extending substantially parallel to each other, and an image printing unit 13 is supported by guide rails 11 and 12, such that image printing unit 13 is slidable in a scanning direction. Image printing unit 13 may be joined to a timing belt 16 which is wound around a pair of pulleys 14 and 15, and timing belt 16 may extend in a direction substantially parallel to a direction in which guide rail 12 extends. Pulley 15 may be coupled to a motor (not shown) which may be driven to rotate in a forward direction and a reverse direction. When pulley 15 is driven to rotate in the forward and reverse directions, timing belt 16 moves, such that image printing unit 13 reciprocates in the scanning direction along guide rails 11 and 12.

Image printing unit 13 may comprise a carriage 17, which may serve as a casing, and buffer tanks 18 may be mounted to carriage 17. Cartridge mounting portion 19 may be positioned in front of the right end of guide rail 12. Four ink cartridges 20A to 20D, having ink in four colors (black, cyan, magenta, and yellow) respectively stored therein, may be removably mounted to cartridge mounting portion 19. Ink cartridges 20A to 20D mounted to cartridge mounting portion 19 may be connected to respective buffer tanks 18 via ink supply tubes 21.

Figure 3:
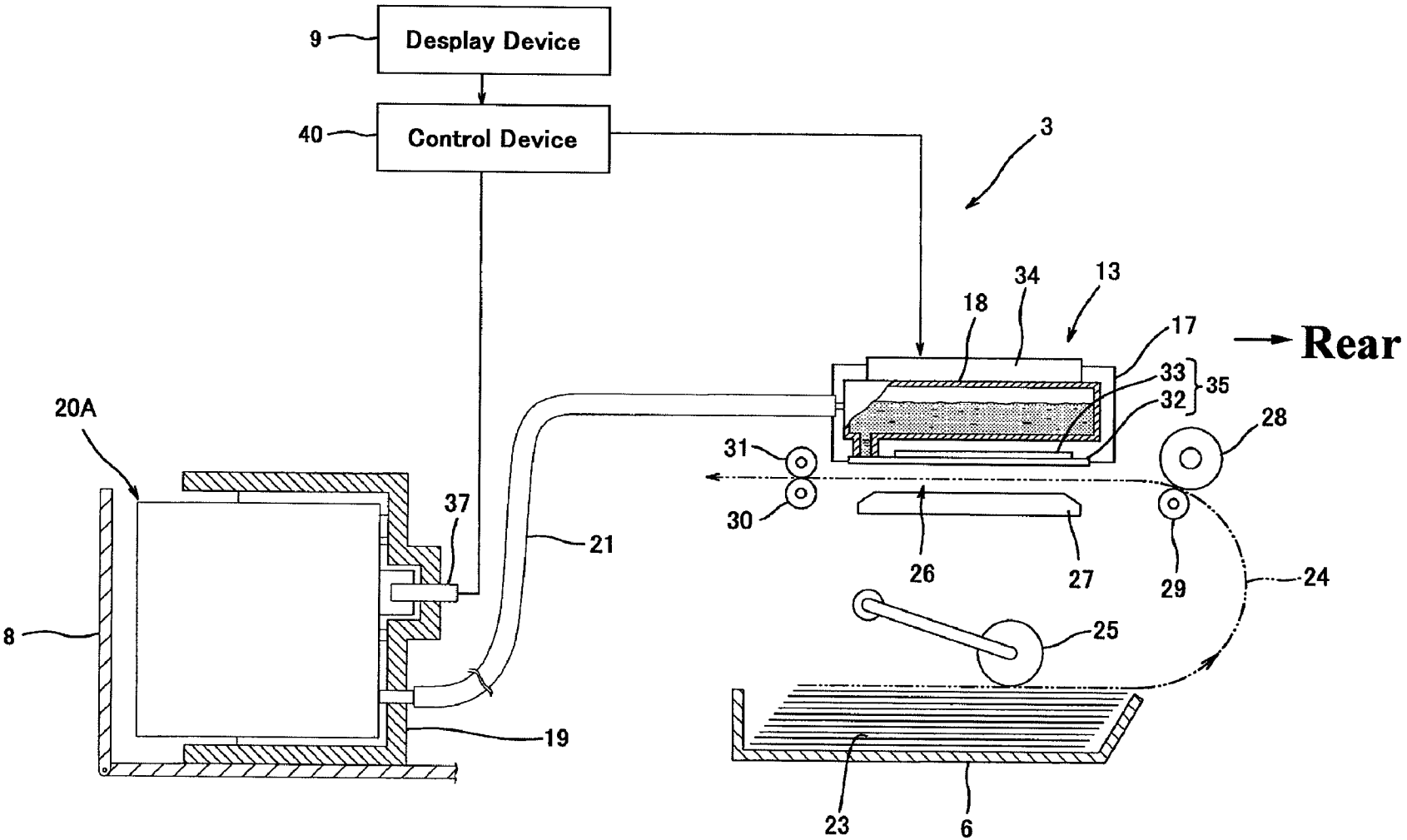
FIG. 3 is a schematic, partial, cross-sectional view of the ink-jet printer of FIG. 1.

Referring to FIG. 3, paper feed tray 6 may be positioned at the bottom of multifunction device 1. A paper feed roller 25 may be positioned above paper feed tray 6 and may be configured to feed an uppermost sheet of paper 23 from paper feed tray 6 to a paper feed path 24. Paper feed path 24 may extend upward from the rear side of paper feed tray 6, make a U-turn toward the front of the multifunction device, and then extend through a printing area 26 to paper discharge tray 7.

Image printing unit 13 may be positioned in printing area 26. A platen 27 may be positioned below image printing unit 13, and the size of platen 27 may be greater than the size of the sheet of paper 23. A transporting roller 28 and a pinch roller 29 may be positioned at an upstream side of image printing unit 13 with respect to paper feed path 24. Transporting roller 28 and pinch roller 29 may pinch the sheet of paper 23 fed along paper feed path 24 and transport the sheet of paper 23 to above platen 27. A paper discharge roller 30 and a pinch roller 31 may be positioned at a downstream side of image printing unit 13 with respect to paper feed path 24. Paper discharge roller 30 and pinch roller 31 may pinch the sheet of paper 23 passing above platen 27 and transport the sheet of paper 23 to paper discharge tray 7.

Image printing unit 13 may comprise an ink-jet head 35 configured to discharge ink from a plurality of nozzles formed therein toward platen 27, buffer tanks 18 configured to temporarily store ink to be supplied to ink-jet head 35, a head control board 34 configured to control driving of ink-jet head 35, and a carriage 17 on which ink-jet head 35, buffer tanks 18, and head control board 34 may be mounted. Ink-jet head 35 may comprise a flow channel unit 32 configured to guide ink supplied from buffer tanks 18 to the nozzles, and a piezoelectric actuator 33 positioned above flow channel unit 32, and configured to selectively provides ink in flow channel unit 32 with discharge pressure directed to nozzles.

Ink cartridges 20A to 20D may be connected to respective buffer tanks 18 via the cartridge mounting portion 19 and ink supply tubes 36.

Cartridge mounting portion 19 may comprise four sensors 37 for optically detecting the remaining amounts of ink stored in mounted ink cartridges 20A to 20D, respectively. A control device 40 may be electrically connected to sensors 37, display device 9, and head control board 34. Control device 40 may determine the remaining amounts of ink in ink cartridges 20A to 20D from data output from sensors 37 and head control board 34, and may cause display device 9 to display the remaining amounts of ink.

Figure 4:
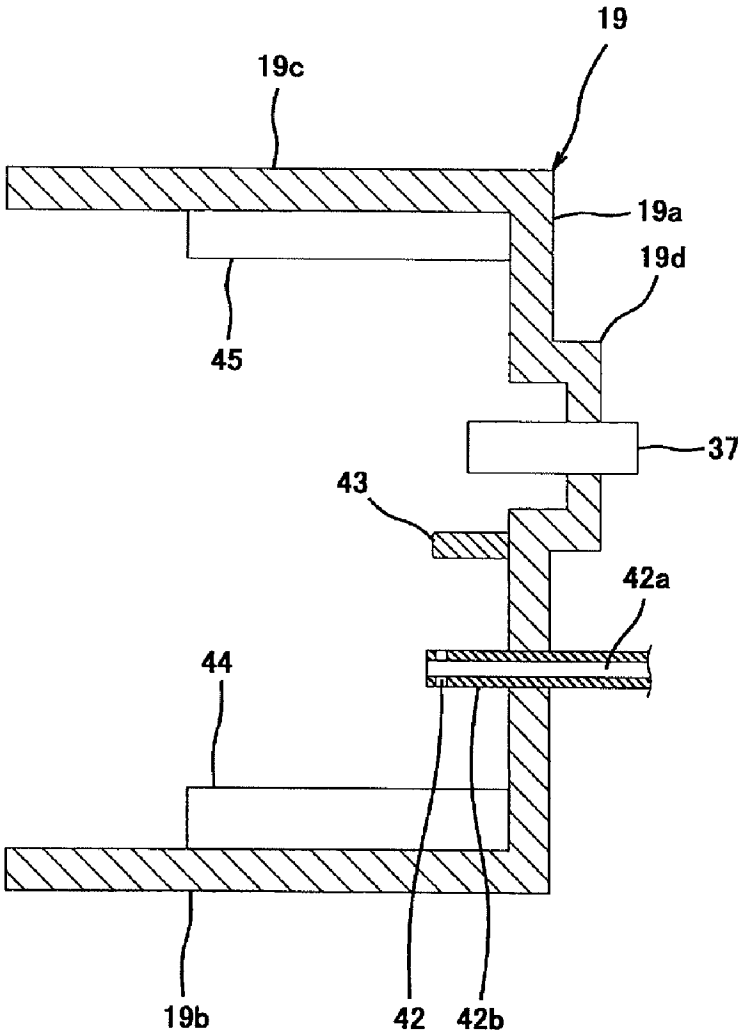
FIG. 4 is a cross-sectional view of a cartridge mounting portion and an ink cartridge of the ink-jet printer of FIG. 1.
Figure 4:
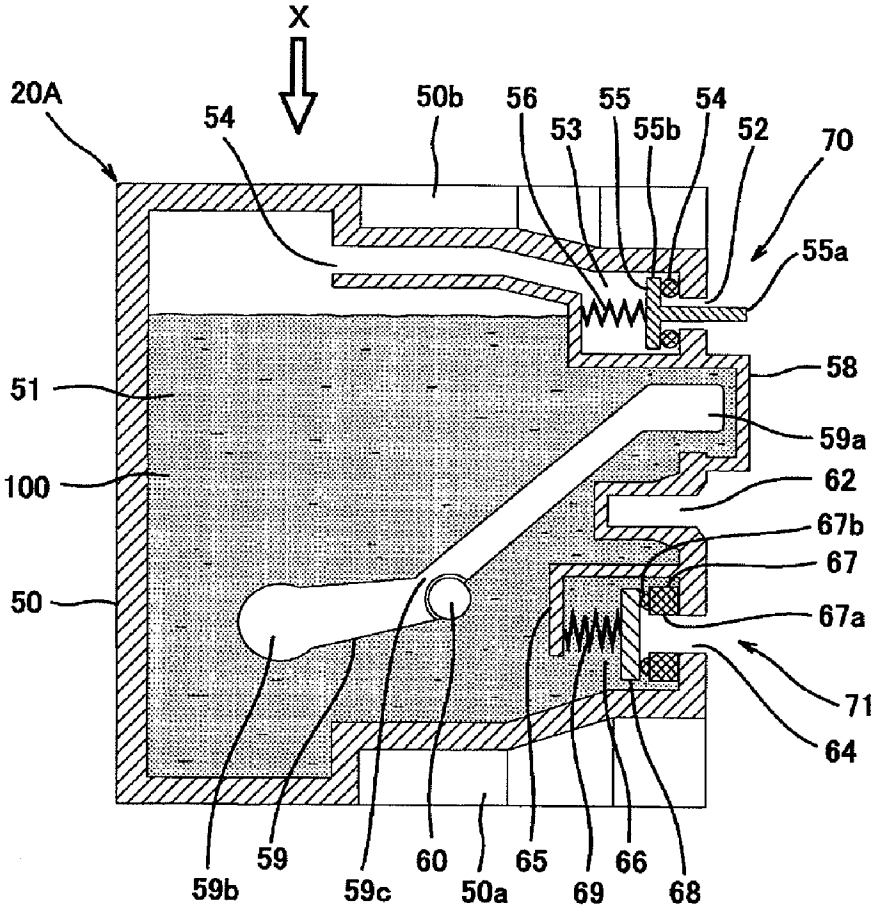
Figure 5:
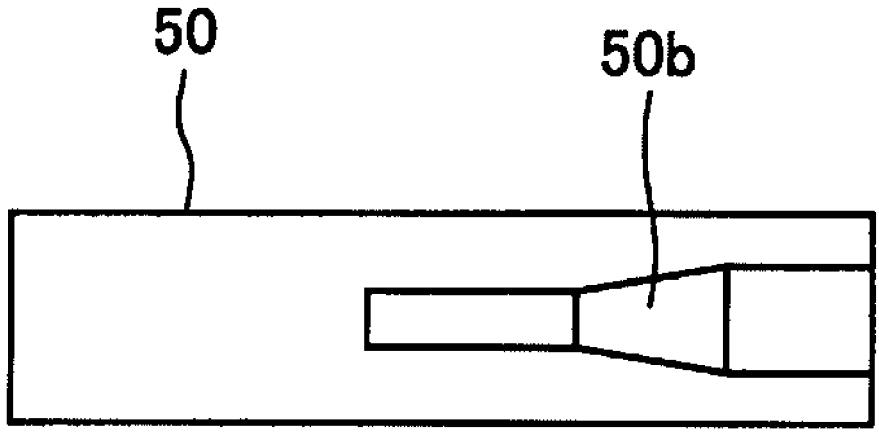
FIG. 5 is a top view of the ink cartridge seen in a direction of an arrow X in FIG. 4.

Ink cartridge 20A is described in reference to FIG. 4. Because the four ink cartridges 20A to 20D may have substantially the same structure, the same description applies to ink cartridges 20B to 20D.

Referring to FIG. 4, ink cartridge 20A may comprise a case 50 comprising an ink chamber 51 formed therein, and ink chamber 51 may be configured to store ink 100 therein. When ink cartridge 20A is manufactured, the interior of ink chamber 51 may be depressurized to a level less than the atmospheric pressure to remove gas dissolved in ink stored in ink chamber 51, and ink cartridge 20A may be packed and shipped in a depressurized state. An air communication opening 52 may be formed through a front wall of case 50. The front wall of case 50 may be positioned at the front of case 50 during the mounting of ink cartridge 20A to cartridge mounting portion 19. Air communication opening 52 may be positioned adjacent to a top wall of case 50. The top wall of case 50 may be positioned at the top of case 50 during the mounting of ink cartridge 20A to cartridge mounting portion 19. Ink cartridge 20A may comprise an air communication closing mechanism 70 positioned at air communication opening 52, and air communication closing mechanism 70 may be configured to cover air communication opening 52. Air communication closing mechanism 70 may comprise a valve storage chamber 53 which is continuous with air communication opening 52. Air communication closing mechanism 70 may comprise an annular sealing member 54 positioned in valve storage chamber adjacent to air communication opening 52.

Valve storage chamber 53 may extend from air communication opening 52 toward ink chamber 51. Air communication closing mechanism 70 may comprise an air communication valve element 55 stored in valve storage chamber 53, a rod member 55*a* extending through air communication opening 52 to the exterior of case 50, and a flange portion 55*b* which may extend radially outward from an end portion of rod member 55*a* in valve storage chamber 53. Air communication valve element 55 may comprise a spring 56, and air communication valve element 55 may be urged by spring 56, such that flange portion 55*b* contacts sealing member 54 to cover air communication opening 52. Valve storage chamber 53 may have a communication opening 53*a* which communicates with an air layer formed in an upper portion of ink chamber 51.

Case 50 may have a protrusion 58 extending outward from the front face of case 50. When ink cartridge 20A is mounted to cartridge mounting portion 19, protrusion 58 may be positioned adjacent to sensor 37. Protrusion 58 may comprise side walls extending vertically, and each of the side walls of protrusion 58 may comprise a translucent portion made of a transparent or semi-transparent material. Ink cartridge 20A may comprise a sensor arm 59 positioned in ink chamber 51, and case 50 may comprise a supporting member 60 supporting sensor arm 59 pivotably. Sensor arm 59 may comprise a support potion 59*c* supported by a shaft of supporting member 60, a float portion 59*b* extending from support portion 59*c* in one direction, e.g., to the left in FIG. 4, and an arm portion 59*a* extending from support portion 59*c* in another direction, e.g., to the right in FIG. 4. Float portion 59*b* may have a hollow portion therein, such that the average specific gravity of float portion 59*b* is less than the specific gravity of ink. A distal end of the arm portion 59*a* is positioned in an inner space of protrusion 58.

An ink supply opening 64 may be formed through the front wall of case 50 adjacent to a bottom wall of case 50. The bottom wall of case 50 may be positioned at the bottom of case 50 during the mounting of ink cartridge 20A to cartridge mounting portion 19. Ink cartridge 20A may comprise ink supply closing mechanism 71 positioned at ink supply opening 64, and ink supply closing mechanism 71 may be configured to cover ink supply opening 64. Ink supply closing mechanism 71 may comprise a valve storage chamber 66 which is continuous with ink supply opening 64. Valve storage chamber 66 may be bounded by a bounding wall 65, having a L-shape in cross-section. A gap may be formed between the bottom wall of case 50 and an end of bounding wall 65, and valve storage chamber 66 may communicate with ink chamber 51 through the gap.

Ink supply closing mechanism 71 may comprise an ink supply valve element 68 and an annular sealing member 67 stored in valve storage chamber 66. Annular sealing member 67 may be positioned adjacent to ink supply opening 64, such that a center opening 67*a* is aligned with ink supply opening 64. Ink supply closing mechanism 71 may comprise a spring 69 stored in valve storage chamber 66. Ink supply valve element 68 may be urged toward annular sealing member 60 by spring 69, such that ink supply valve element 68 contacts an annular seal lip 67*b* of annular sealing member 67 and covers ink supply opening 64.

Figure 7:
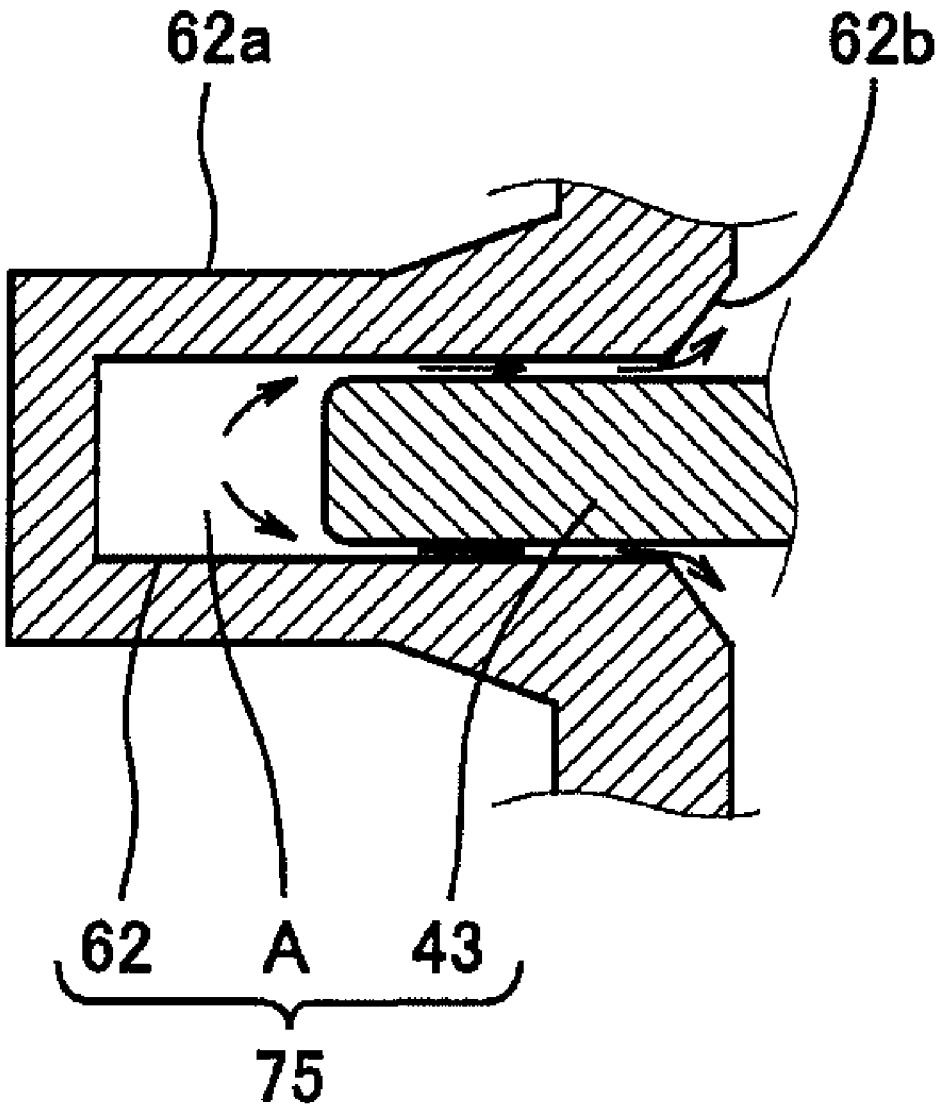
FIG. 7 is an enlarged cross-sectional view of a protrusion and a recess when the protrusion is inserted into the recess according to an embodiment of the invention.

Case 50 may comprise a recess 62 formed in the front wall of case 50 between protrusion 58 and ink supply opening 64. Referring to FIG. 7, recess 62 may comprise a bottomed cylindrical portion 62*a* having a substantially constant diameter and a tapered portion 62*b* whose diameter increases extending from bottomed cylindrical portion 62*a* toward the exterior of case 50. Referring to FIG. 4, the bottom and top surfaces of case 50 may comprise guide grooves 50*a* and 50*b* formed therein, respectively. The diameter of each of guide grooves 50*a* and 50*b* may be greater at a first portion of guide grooves 50*a* and 50*b*, which may be positioned closer to the front wall of case 50, than at a second portion of guide grooves 50*a* and 50*b*, which may be positioned further away from the front wall of case 50 than the first portion. As a result, guide ribs 44 and 45 of cartridge mounting portion 19 readily may enter guide grooves 50*a* and 50*b*, respectively, when ink cartridge 20A is mounted to cartridge mounting portion 19.

Referring to FIG. 4, cartridge mounting portion 19 may comprise an end wall 19*a* extending in the vertical direction, a lower wall 19*b* extending from the lower end of end wall 19*a*, and an upper wall 19*c* extending from the upper end of end wall 19*a* in the same direction in which lower wall 19*b* extends. Lower wall 19*b* and upper wall portion 19*c* may comprise guide ribs 44 and 45, respectively, and guide ribs 44 and 45 may fit into guide grooves 50*a* and 50*b* of ink cartridge 20A, when ink cartridge 20A is mounted to cartridge mounting portion 19.

End wall 19*a* may comprise a recess 19*d* recessed in an opposite direction from the direction in which lower wall 19*b* and upper wall 19*c* extend. Recess 19*d* may be recessed away from ink cartridge 20A, when ink cartridge 20A is mounted to cartridge mounting portion 19. Sensor 37 (e.g., a transmissive photo interrupter) may be provided in recess 19*d*. Sensor 37 may be configured to detect the movement of sensor arm 59, and control device 40 may determine whether the amount of ink 100 in ink chamber 51 reaches a predetermined amount.

A tube 42 may extend from end wall 19*a* in the same direction as lower wall 19*b* and upper wall 19*c* extend. Tube 42 may have an ink flow path 42*a* formed therein. Ink entry openings 42*b* may be formed through tube 42 extending from ink flow path 42*a* to the outer peripheral surface of tube 42 at a portion adjacent to the distal end of tube 42. Ink supply tube 21 may be connected to tube 42 outside cartridge mounting portion 19. A protrusion 43 may extend from end wall 19*a* in the same direction as lower wall 19*b* and upper wall 19*c* extend, and may be positioned between recess 19*d* and tube 42.

Figure 6:
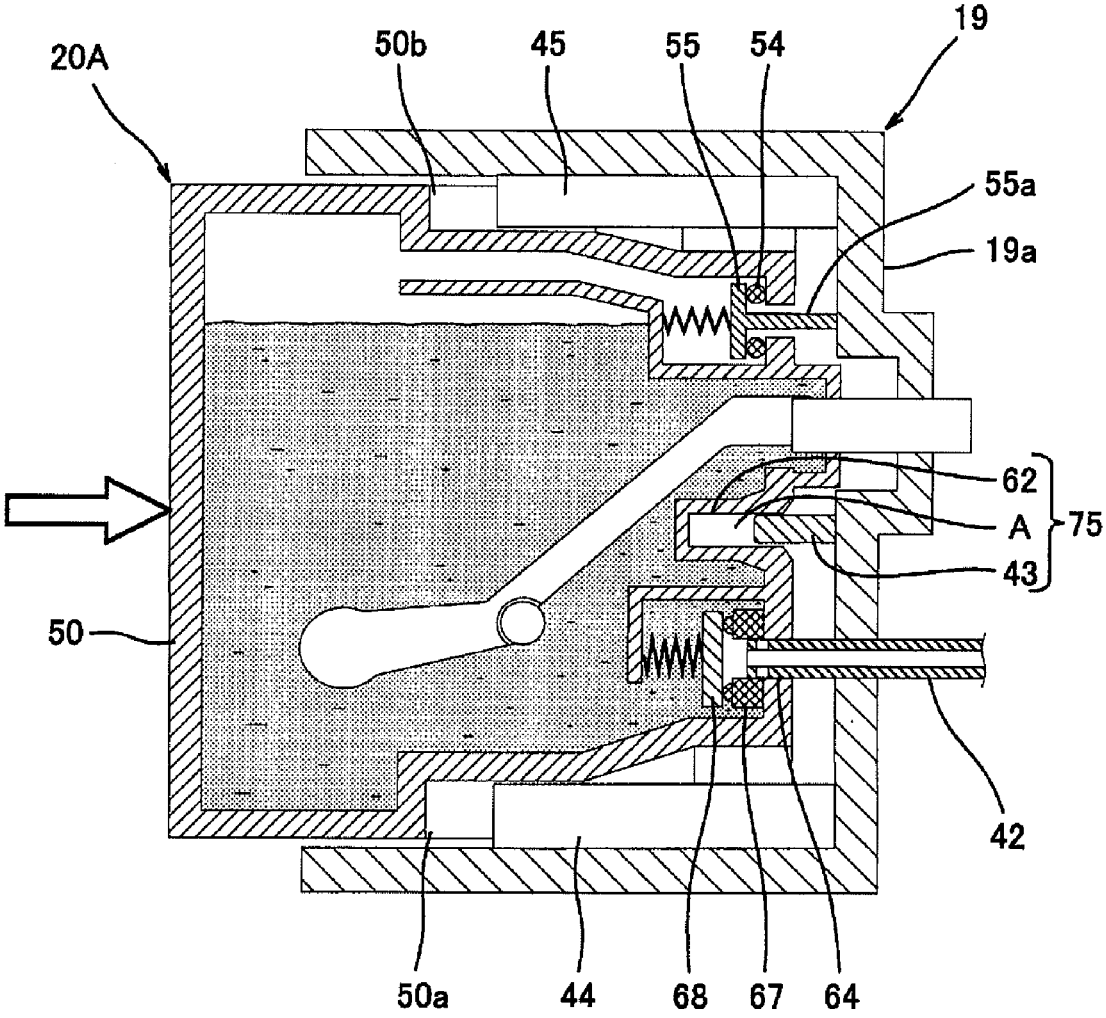
FIG. 6 is a cross-sectional view of the cartridge mounting portion and the ink cartridge of FIG. 4 during a mounting of the ink cartridge to the cartridge mounting portion.
Figure 8:
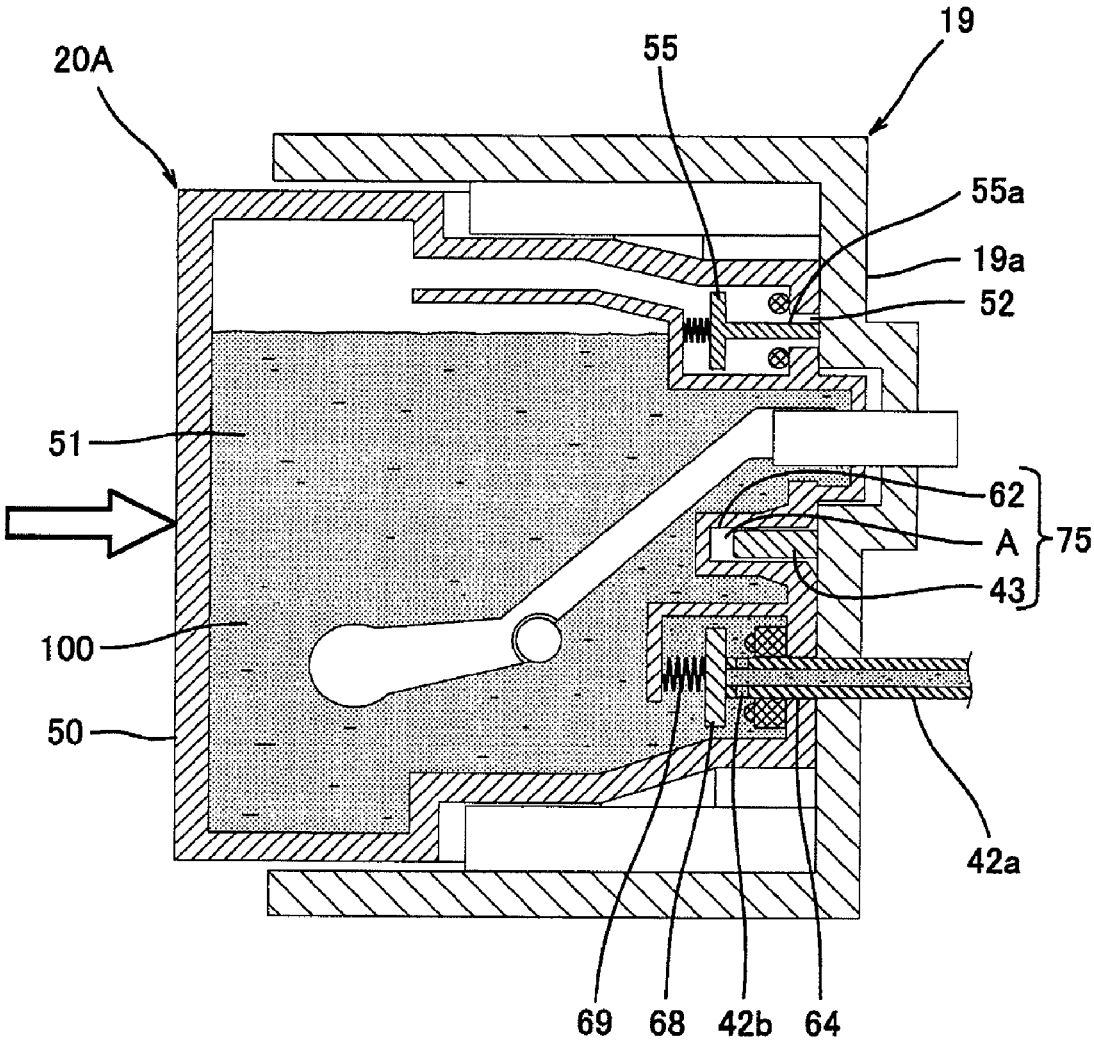
FIG. 8 is a cross-sectional view of the cartridge mounting portion and the ink cartridge of FIG. 4 when the mounting of the ink cartridge to the cartridge mounting portion is completed.

Referring to FIGS. 6 to 8, a mounting operation of ink cartridge 20A to cartridge mounting portion 19 is described. Referring to FIG. 6, when ink cartridge 20A is inserted into cartridge mounting portion 19 by a user, while ink cartridge 20A is guided by guide grooves 50*a* and 50*b* of ink cartridge 20A and guide ribs 44 and 45 of cartridge mounting portion 19, protrusion 43 of cartridge mounting portion 19 may enter recess 62 of ink cartridge 20A.

Subsequently, the distal end of rod member 55*a* of air communication valve element 55 of ink cartridge 20A may contact end wall 19*a* of cartridge mounting portion 19 and be pushed away from annular sealing member 54, such that ink chamber 51 of ink cartridge 20A may be brought into communication with the atmosphere (i.e., air communication opening 52 may be uncovered). When this occurs, referring to FIG. 7, pressurized air A in a space between the distal end of protrusion 43 and the bottom of recess 62 may demonstrate a damping effect. More specifically, recess 62 may have a bottomed cylindrical shape, and the cross-sectional area of a gap between the inner peripheral surface of bottomed cylindrical portion 62*a* of recess 62 and the outer peripheral surface of protrusion 43 may be 1/300 to 1/400 of the cross-sectional area of recess 62, when viewed in a direction in which protrusion 43 enters recess 62. Therefore, air A between the distal end of protrusion 43 and the bottom of recess 62 may be compressed and pressurized when the mounting speed is sufficiently high, which creates a damping effect.

When protrusion 43 enters recess 62 quickly, it may be difficult for air A to escape via the gap between protrusion 43 and recess 62. As a result, air A may be compressed and pressurized between the distal end of protrusion 43 and the bottom recess 62, and pressurized air A may cause an increasing resistance. Consequently, a mounting force applied to ink cartridge 20A by the user when the user mounts ink cartridge 20A to cartridge mounting portion 19 may be opposed by damper 75, which comprises recess 62, protrusion 43, and pressurized air A. In addition, the greater the mounting speed of ink cartridge 20A to cartridge mounting portion 19 is, the more difficult it becomes for air to escape through the gap, and the greater the mounting resistance by the pressurized air A may become. Therefore, the amount of the reduction of the mounting speed of ink cartridge 20A may increase in proportion with an increase of the mounting speed.

When protrusion 43 enters recess 62 slowly, however, air A may leak smoothly via the gap between protrusion 43 and recess 62. As a result, air A between the distal end of protrusion 43 and the bottom of recess 62 may not be very compressed, and the mounting resistance may be small. The mounting resistance of damper 75 may not depend on the position of ink cartridge 20A with respect to cartridge mounting portion 19, but may depend only on the mounting speed. Therefore, when the user inserts ink cartridge 20A into cartridge mounting portion 19 slowly, the user may feel little resistance.

Subsequently, referring to FIGS. 7 and 8, when ink cartridge 20A is further pressed toward end wall 19*a*, tube 42 may enter ink supply opening 64 and then enter center opening 67*a* of annular sealing member 67 in a liquid-tight manner. Tube 42 also may push ink supply valve element 68 away from annular sealing member 67, such that ink chamber 51 of ink cartridge 20A may be brought into communication with ink entry openings 42*b* of tube 42 (i.e., ink supply opening 64 may be uncovered). Air communication valve element 55 and ink supply valve element 68 may be positioned, such that ink supply opening 64 is uncovered after air communication opening 52 is uncovered, when ink cartridge 20A is mounted to cartridge mounting portion 19. Even if the mounting operation of ink cartridge 20A by the user is quick, because the mounting speed is reduced by damper 75, there may be a sufficient amount of time between the uncovering of air communication opening 52 and the uncovering of ink supply opening 64 for the pressure in the ink chamber to equalize with the atmospheric pressure. Therefore, ink chamber 51 may be brought into communication with ink-jet head 35 after the pressure in ink chamber 51 reaches the atmospheric pressure or reaches a pressure close to the atmospheric pressure, thereby preventing entry of air from the nozzles into ink-jet head 35 due to, for example, a reverse flow of ink from ink-jet head 35 toward ink cartridge 20A.

Figure 9:
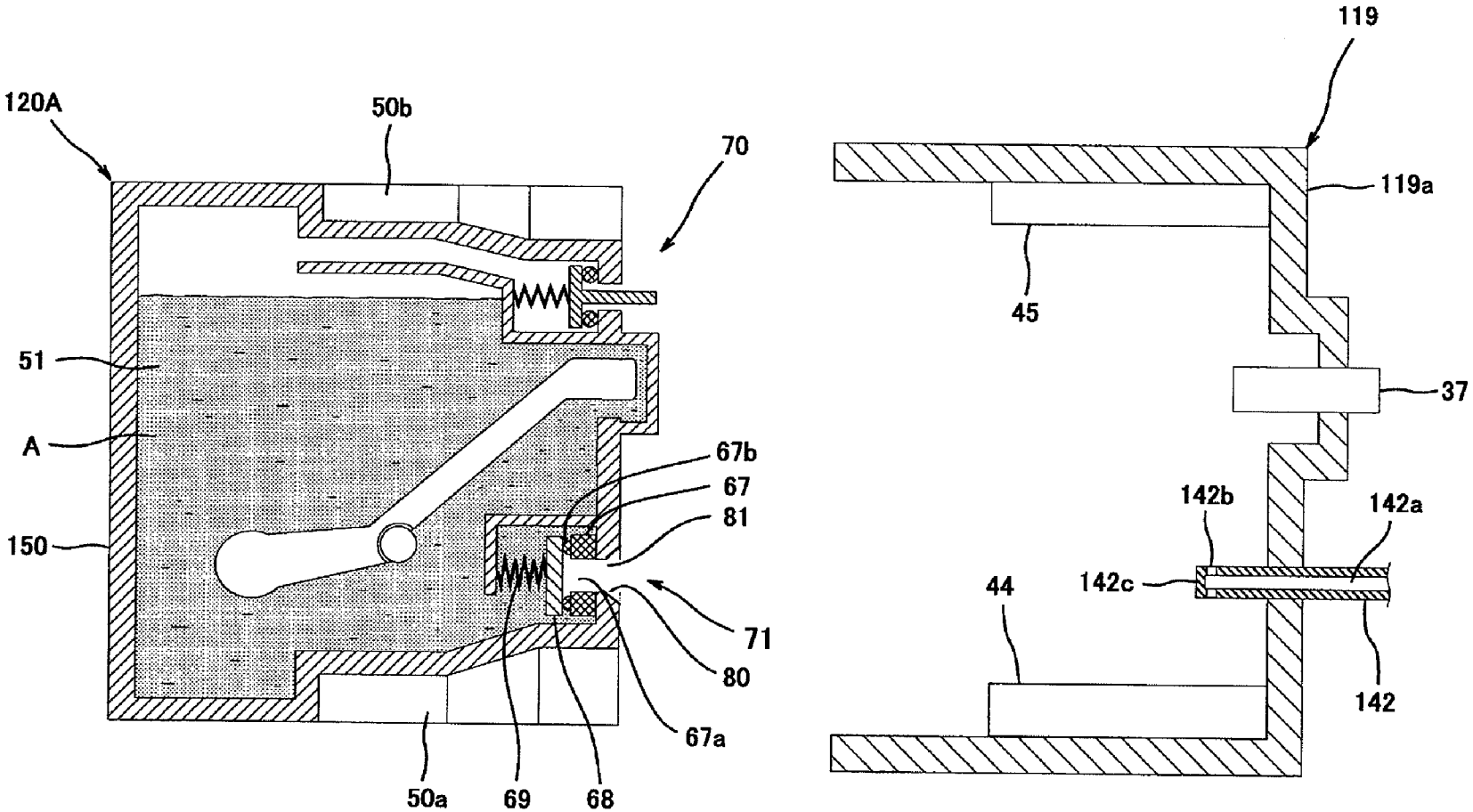
FIG. 9 is a cross-sectional view of a cartridge mounting portion and an ink cartridge according to another embodiment of the invention.

Referring to FIG. 9, an ink cartridge 120A and a cartridge mounting portion 119 according to another embodiment of the invention is described. In this embodiment, ink cartridge 120A may not comprise recess 62 formed therein, and cartridge mounting portion 119 may not comprise protrusion 43.

Ink cartridge 120A may comprise case 150, which is similar to case 50 of ink cartridge 20A. An ink supply opening 80 may be formed through a front wall of case 150. The front wall of case 150 may be positioned at the front of case 150 during the mounting of ink cartridge 120A to cartridge mounting portion 119. Ink supply opening 80 may be positioned adjacent to a bottom wall of case 150. The bottom wall of case 150 may be positioned at the bottom of case 150 during the mounting of ink cartridge 120A to cartridge mounting portion 119. Ink supply opening 80, which is similar to ink supply opening 64 of ink cartridge 20A, may be tapered at the front end. A recess 81 may encircle ink supply opening 80 and center opening 67*a*. Recess 81 may comprise a cylindrical-shaped inner surface of annular sealing member 67, and a bottom defined by an external surface of ink supply valve element 68.

A tube 142 may extend from an end wall 119*a* of cartridge mounting portion 119 in a manner similar to tube 42. Tube 142 may have an ink flow path 142*a* formed therein. Ink entry openings 142*b* may be formed through tube 142 extending from ink flow path 142*a* to the outer peripheral surface of tube 142 at a portion adjacent to the distal end of tube 142. The distal end of tube 142 may be closed by a distal end wall 142*c* of tube 42. Ink supply tube 21 may be connected to tube 142 outside cartridge mounting portion 119 (not shown in FIG. 9).

Figure 10:
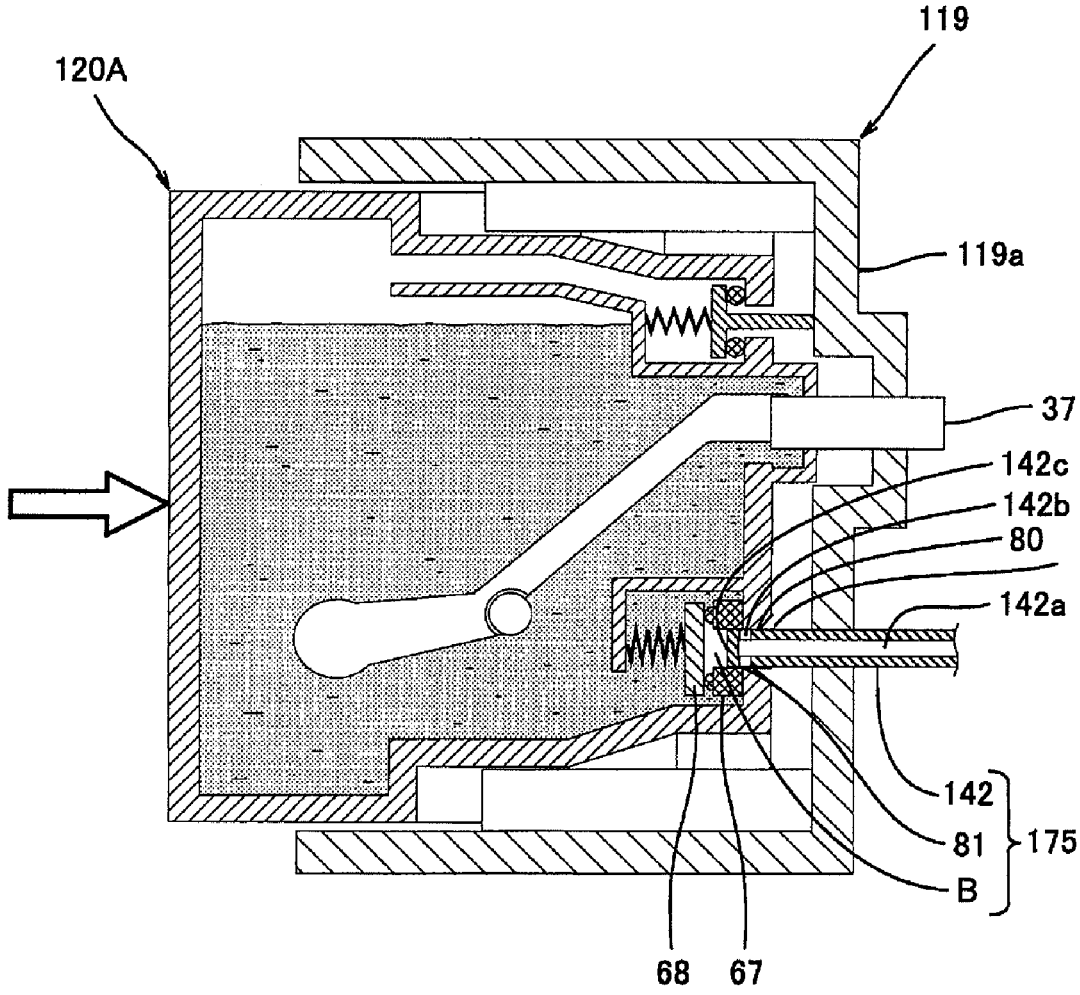
FIG. 10 is a cross-sectional view of the cartridge mounting portion and the ink cartridge of FIG. 9 during a mounting of the ink cartridge to the cartridge mounting portion.
Figure 11:
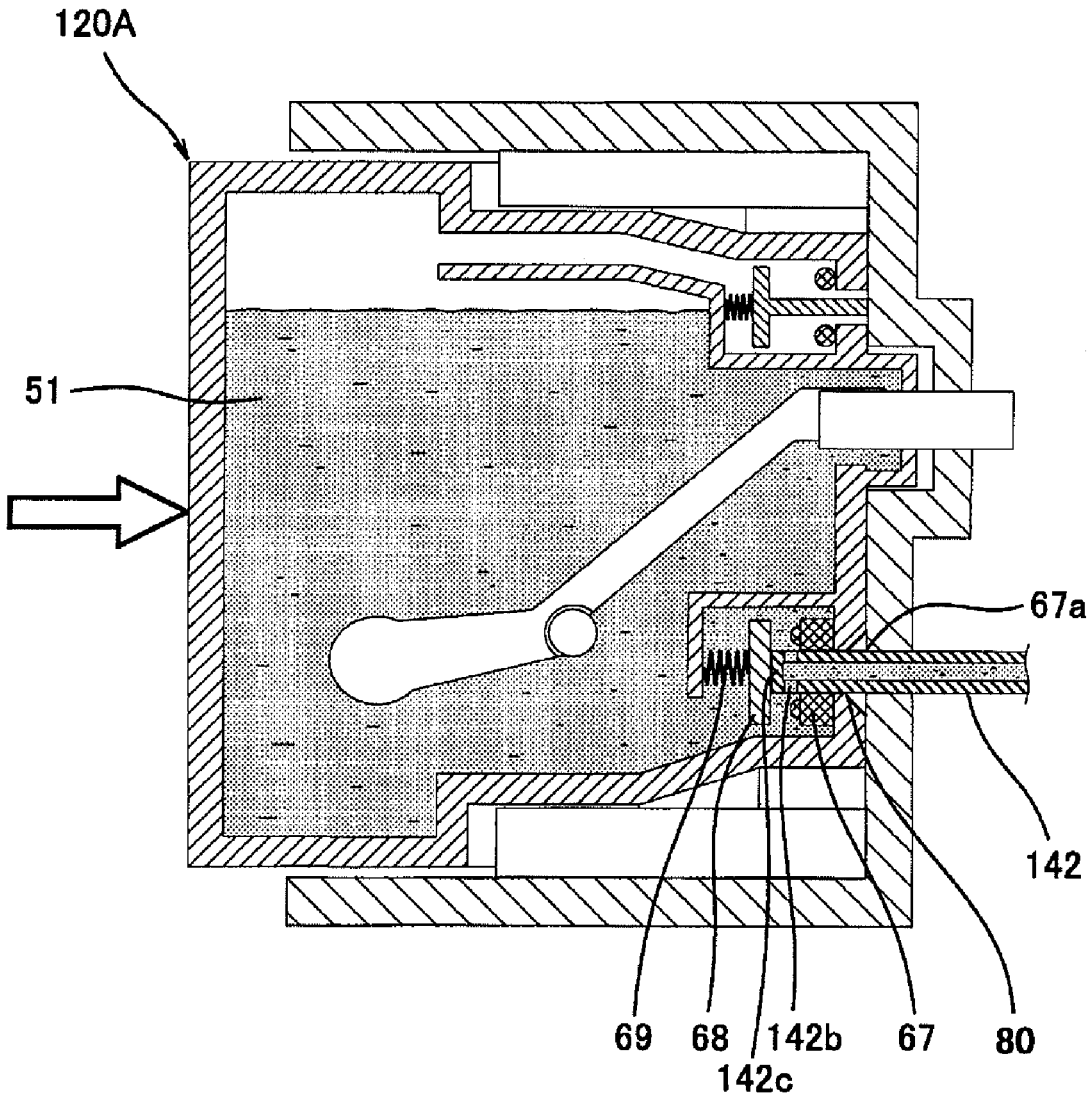
FIG. 11 is a cross-sectional view of the cartridge mounting portion and the ink cartridge of FIG. 9 when the mounting of the ink cartridge to the cartridge mounting portion is completed

Referring to FIGS. 10 and 11, a mounting operation for mounting the ink cartridge 120A to cartridge mounting portion 119 is described. Referring to FIG. 10, when ink cartridge 120A is inserted into cartridge mounting portion 119 by a user, the distal end of rod member 55*a* of air communication valve element 55 of ink cartridge 120A may contact end wall 119*a* of cartridge mounting portion 119 and may be pushed away from annular sealing member 54, such that ink chamber 51 of ink cartridge 120A may be brought into communication with the atmosphere (i.e., air communication opening 52 may be uncovered). When air communication opening 52 is uncovered in this manner, distal end wall 142*c* of tube 42 may enter ink supply opening 80 of ink cartridge 120A, and a damping effect may be caused by contact with pressurized air B in a space formed between distal end wall 142*c* of tube 142 and the bottom of recess 81 (i.e., ink supply valve element 68 may demonstrate a damping effect). More specifically, recess 81 may have a bottomed cylindrical shape, and the cross-sectional area of a gap between ink supply opening 80 and the outer peripheral surface of tube 142 may be 1/300 to 1/400 of the cross-sectional area of ink supply opening 80, when viewed in a direction in which tube 42 enters ink supply opening 80. Therefore, air B between distal end wall 142*c* of tube 142 and the bottom of recess 81 may be compressed and pressurized, when tube 142 enters supply opening 80. Accordingly, recess 81 may function in a manner similar to recess 62, and tube 142 may function in a manner similar to protrusion 43. In this manner, the mounting force applied to ink cartridge 120A by the user when the user mounts ink cartridge 120A to cartridge mounting portion 119 may be opposed by a damper 175, which comprises recess 81, tube 142, and pressurized air B. As described in reference to previous embodiments, the amount of the reduction of the mounting speed of ink cartridge 120A may increase in proportion with an increase of the mounting speed.

When tube 142 enters ink supply opening 80 slowly, however, air B may leak smoothly via the gap between tube 142 and ink supply opening 80. As a result, air B between distal end wall 142*c* of tube 142 and the bottom of recess 81 only may be slightly compressed, such that the mounting resistance may be small. Therefore, when the user insert ink cartridge 120A into cartridge mounting portion 119 slowly, the user may feel little resistance.

Subsequently, referring to FIG. 11, tube 142 may enter center opening 67*a* of annular sealing member 67 in a liquid-tight manner, and tube 142 may push ink supply valve element 68 away from annular sealing member 67, such that ink chamber 51 of ink cartridge 120A may be brought into communication with ink entry openings 142*b* of tube 142 (i.e., ink supply opening 80 may be uncovered). As described above, even if the user tries to insert ink cartridge 120A into cartridge mounting portion 119 quickly, the mounting speed may be reduced by damper 175 immediately before tube 142 pushes the ink supply valve element 68. Accordingly, there may be a sufficient amount of time between uncovering air communication opening 52 and uncovering ink supply opening 80 for the pressure in the ink chamber to equalize with the atmospheric pressure. Therefore, ink chamber 51 may be brought into communication with ink-jet head 35 after the pressure in ink chamber 51 reaches the atmospheric pressure or reaches a pressure close to the atmospheric pressure, thereby preventing entry of air from the nozzles into ink-jet head 35 due to, for example, generation of a reverse flow of ink from ink-jet head 35 toward ink cartridge 20A. Moreover, in this embodiment, the necessity to provide a damper, e.g., damper 75, in an area other than ink supply opening 80 may be eliminated, thereby making it possible to reduce the size and/or complexity of ink cartridge 120A and cartridge mounting portion 119.

Figure 12:
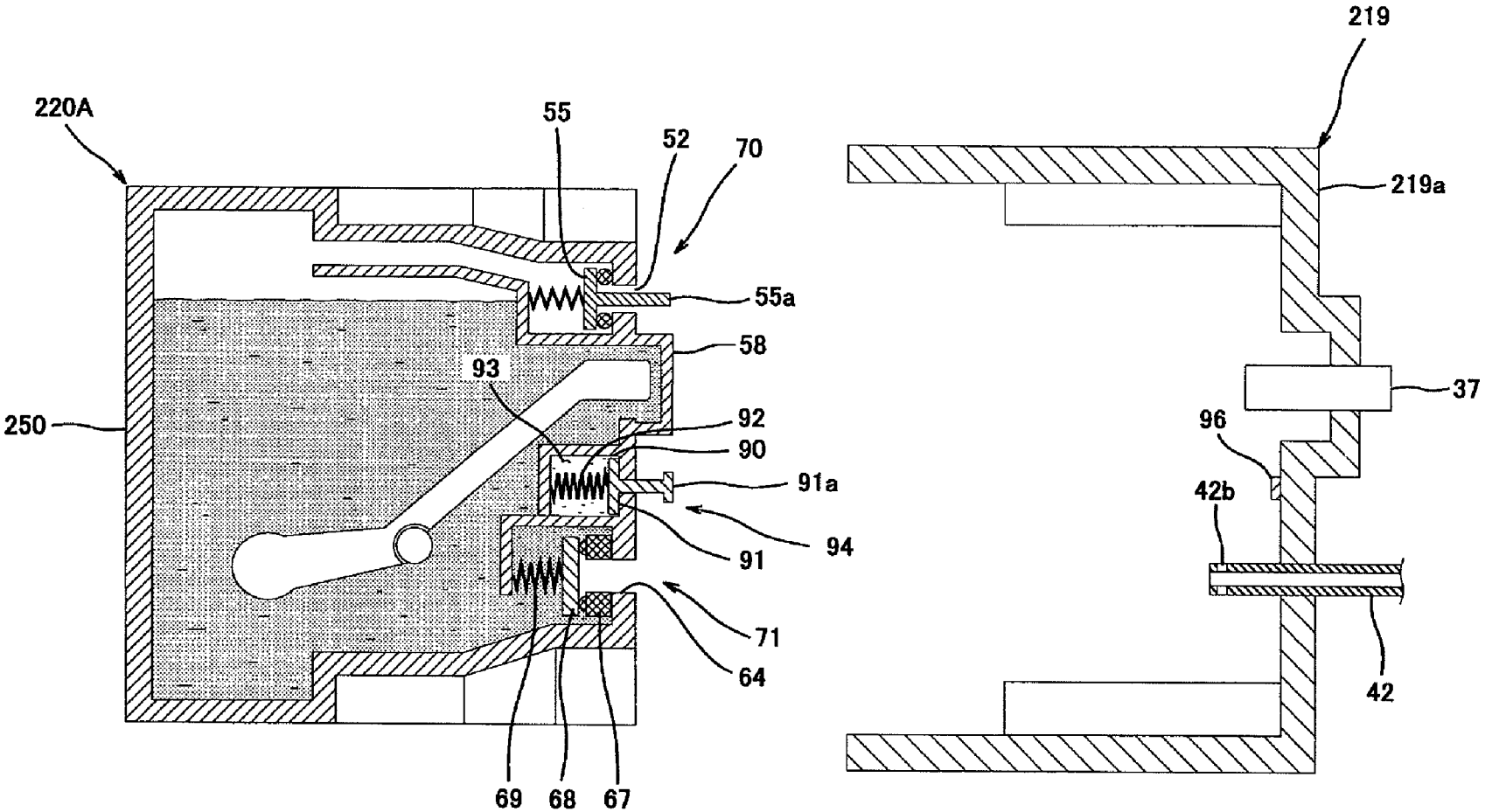
FIG. 12 is a cross-sectional view of a cartridge mounting portion and an ink cartridge according to yet another embodiment of the invention.

Referring to FIG. 12, a cartridge mounting portion 219 and an ink cartridge 220A according to yet another embodiment of the invention is described. Ink cartridge 220A may comprise a liquid damper 94 between ink supply closing mechanism 71 and protrusion 58 at a front wall of case 250 of ink cartridge 220A. Liquid damper 94 may comprise a cylinder 90 formed integrally with case 250, a piston 91 positioned in cylinder 90, liquid 93 (e.g., water or oil stored in cylinder 90), and a spring 93, which urges piston 91 to the front of case 250. A slight gap may be formed between the outer peripheral surface of piston 91 and the inner peripheral surface of cylinder 90. Piston 91 may comprise a piston rod 91 a extending from case 250 to the exterior of case 250. Cartridge mounting portion 119 may comprise a pressing portion 96 extending from an end wall 219*a* of cartridge mounting portion 219 at a position corresponding to liquid damper 94.

Figure 13:
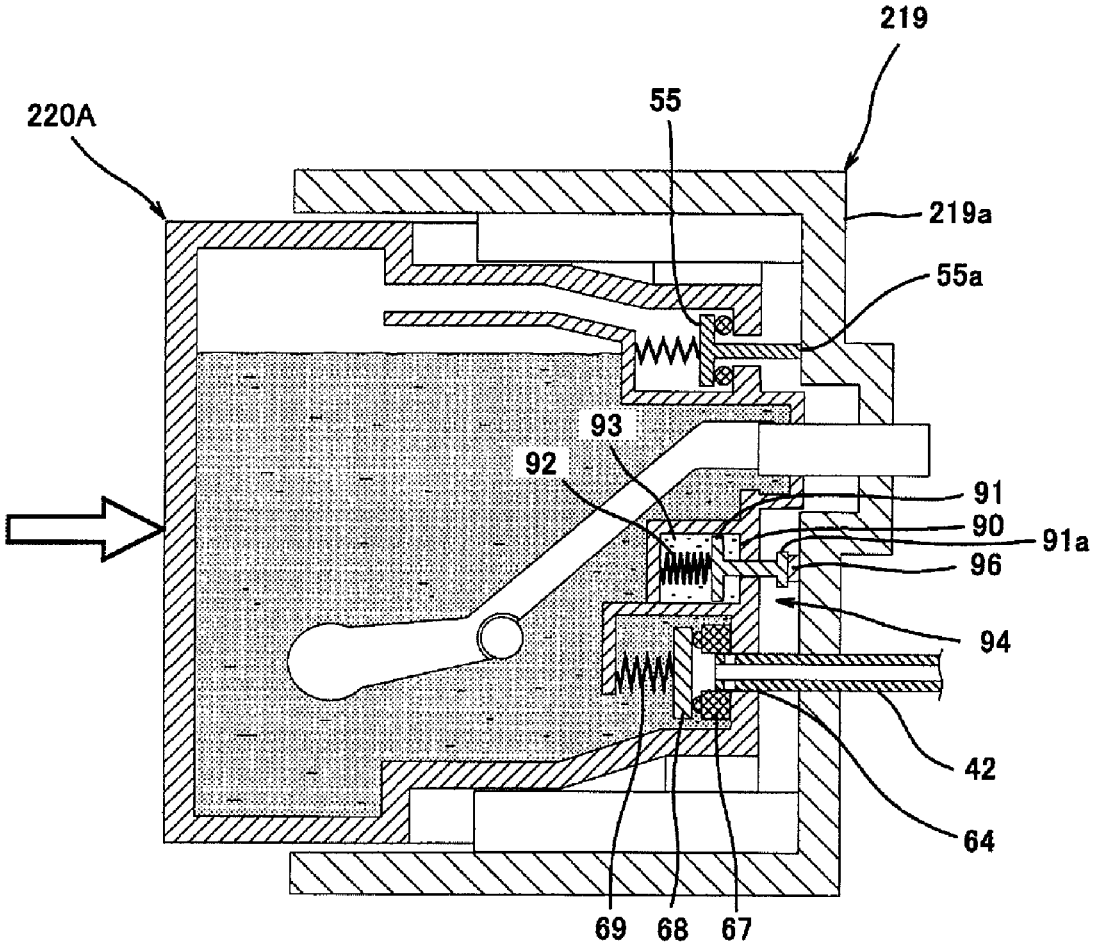
FIG. 13 is a cross-sectional view of the cartridge mounting portion and the ink cartridge of FIG. 12 during a mounting of the ink cartridge to the cartridge mounting portion.
Figure 14:
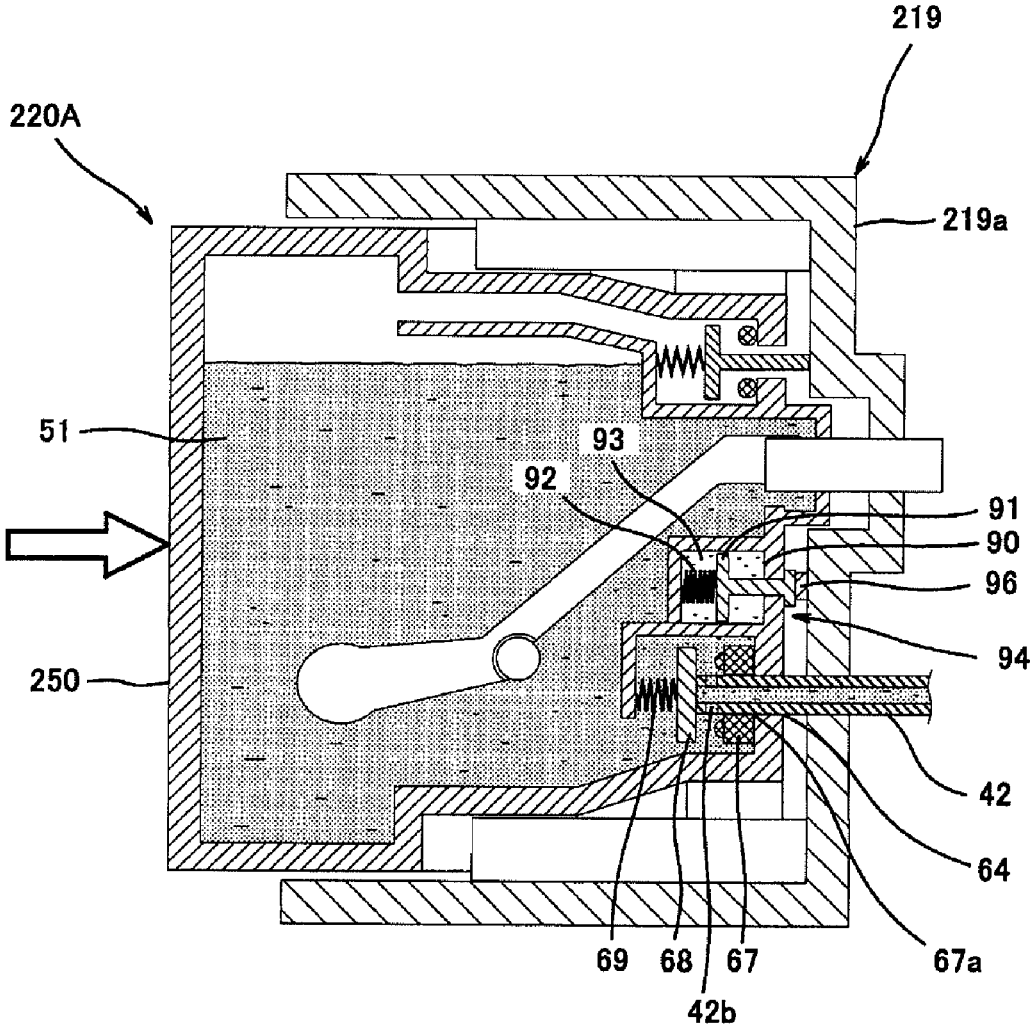
FIG. 14 is a cross-sectional view of the cartridge mounting portion and the ink cartridge of FIG. 12 when the mounting of the ink cartridge to the cartridge mounting portion is completed.

Referring to FIGS. 13 and 14, a mounting operation for mounting ink cartridge 220A to cartridge mounting portion 219 is described. Referring to FIG. 13, when ink cartridge 220A is inserted into cartridge mounting portion 219 by a user, the distal end of rod member 55*a* may contact end wall 219*a* of cartridge mounting portion 219 and may be pushed away from annular sealing member 54, such that ink chamber 51 of ink cartridge 220A may be brought into communication with the atmosphere (i.e., air communication opening 52 may be uncovered). When air communication opening 52 is uncovered in this manner, pressing portion 96 of cartridge mounting portion 219 may press piston rod 91*a* of ink cartridge 220A, and a mounting force applied to ink cartridge 220A by the user may be opposed by liquid damper 94. Therefore, the amount of reduction of the mounting speed of ink cartridge 220A may increase in proportion with an increase of the mounting speed.

When pressing portion 96 presses piston rod 91*a* slowly, however, liquid 93 may flow smoothly via the gap between the inner peripheral surface of cylinder 90 and outer peripheral surface of piston 91. As a result, liquid 93 between piston 91 and cylinder 90 may be compressed only slightly, and the mounting resistance may be small. Therefore, when the user inserts ink cartridge 220A into cartridge mounting portion 219 slowly, the user may feel little resistance.

Subsequently, referring to FIG. 14, tube 42 may enter ink supply opening 64 and then enter center opening 67*a* of annular sealing member 67 in a liquid-tight manner. Tube 42 may push ink supply valve element 68 away from annular sealing member 67, such that ink chamber 51 of ink cartridge 220A may be brought into communication with ink entry openings 42*b* of tube 42 (i.e., ink supply opening 64 may be uncovered). Even if the user tries to mount ink cartridge 220A to cartridge mounting portion 219 quickly, the mounting speed may be reduced by liquid damper 94 immediately before ink supply opening 64 is uncovered. Accordingly, there may be a sufficient amount of time between uncovering air communication opening 52 and uncovering ink supply opening 64 for the pressure in the ink chamber to equalize with the atmospheric pressure. Therefore, ink chamber 51 may be brought into communication with ink-jet head 35 (see FIG. 3) after the pressure in ink chamber 51 reaches the atmospheric pressure or reaches a pressure close to the atmospheric pressure, thereby preventing entry of air from the nozzles into ink-jet head 35 due to, for example, generation of reverse flow of the ink from the ink-jet head 35 toward the ink cartridge 220A.

Figure 15:
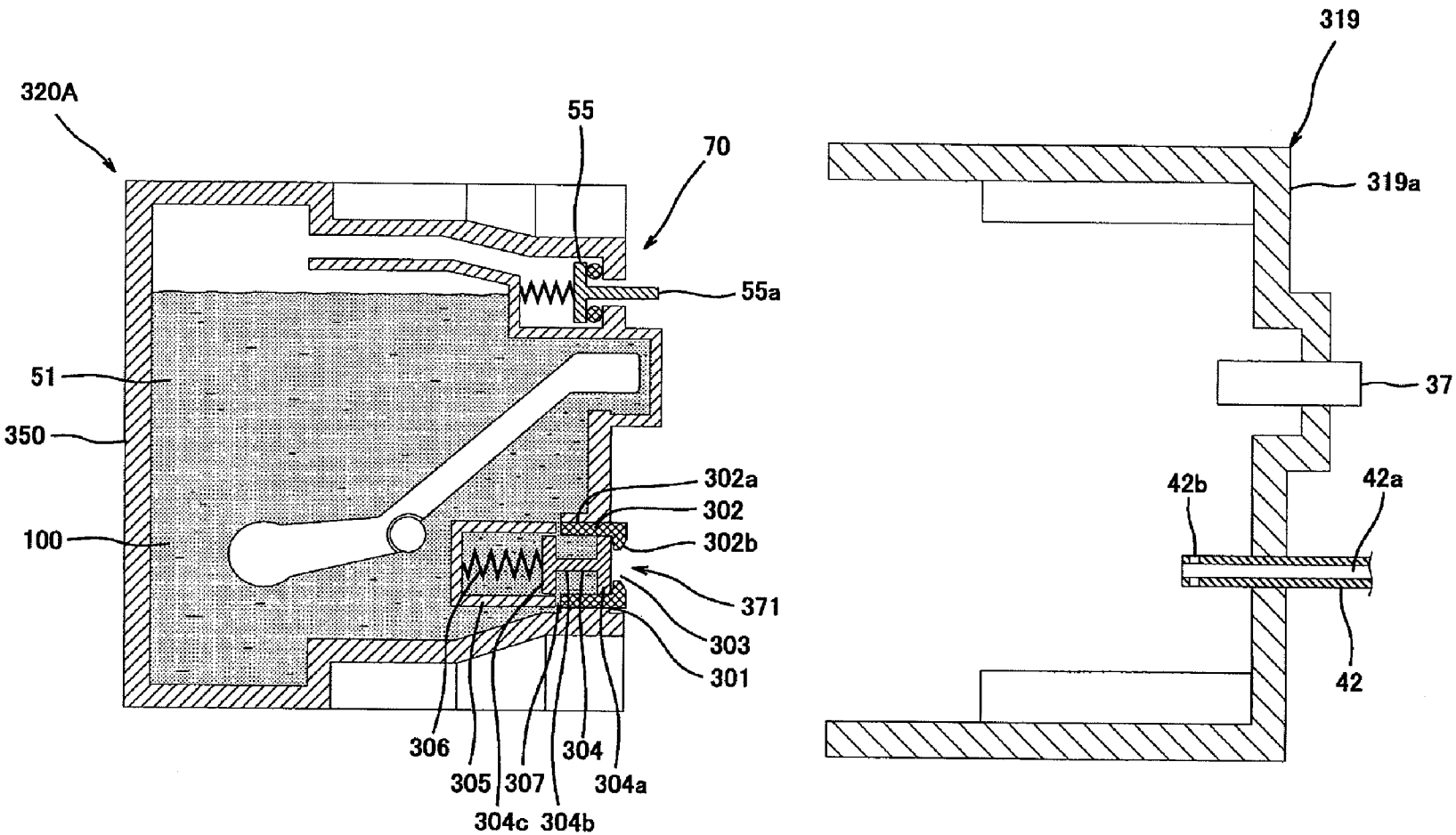
FIG. 15 is a cross-sectional view of a cartridge mounting portion and an ink cartridge according to still another embodiment of the invention.

Referring to FIG. 15, a cartridge mounting portion 319 and an ink cartridge 320A according to still another embodiment is described. In this embodiment, ink cartridge 320A may not comprise recess 62 or liquid damper 94, and cartridge mounting portion 319 may not comprise protrusion 43.

Ink cartridge 320A may comprise a case 350. Case 350 may comprise an opening 301 formed through a front wall of case 350. The front wall of case 350 may be positioned at the front of case 350 during the mounting of ink cartridge 320A to cartridge mounting portion 319. Ink cartridge 320A may comprise an ink supply closing mechanism 371 positioned in opening 301 of case 350. Ink supply closing mechanism 371 may comprise a tubular sealing member 302 fitted in opening 301 of case 350. Tubular sealing member 302 may have an ink supply opening 303 formed therethrough. Tubular sealing member 302 may comprise a cylindrical portion 302*a*, and a seal lip 302*b* projecting radially inwardly from cylindrical portion 302*a* at a front end of cylindrical portion 302*a*. Ink supply closing mechanism 371 may comprise a piston valve 304, having an H shape when viewed in cross-section. Piston valve 304 may comprise an ink valve element portion 304*a* fitted in tubular sealing member 302, a piston portion 304*c* stored in a cylinder 305, and a connecting rod portion 304*b*, which connects ink valve element portion 304*a* and piston portion 304*c*.

Cylinder 305 may be positioned in an ink chamber 351, such that a center axis of cylinder 305 is aligned with a center axis of tubular sealing member 302 and a gap 307 is formed between cylinder 305 and tubular sealing member 302. Cylinder 305 may be opened toward tubular sealing member 302 and piston portion 304*c* of piston valve 304 may be positioned therein. A slight gap may be formed between the outer peripheral surface of piston portion 304*c* and inner peripheral surface of the cylinder 305. Piston valve 304 may be urged by spring 69 to the front of case 350, and ink valve element portion 304*a* may be tightly fitted in cylindrical portion 302*a*, when ink supply opening 303 is covered. Cartridge mounting portion 319 may comprise tube 42 extending from an end wall 319*a*.

Figure 16:
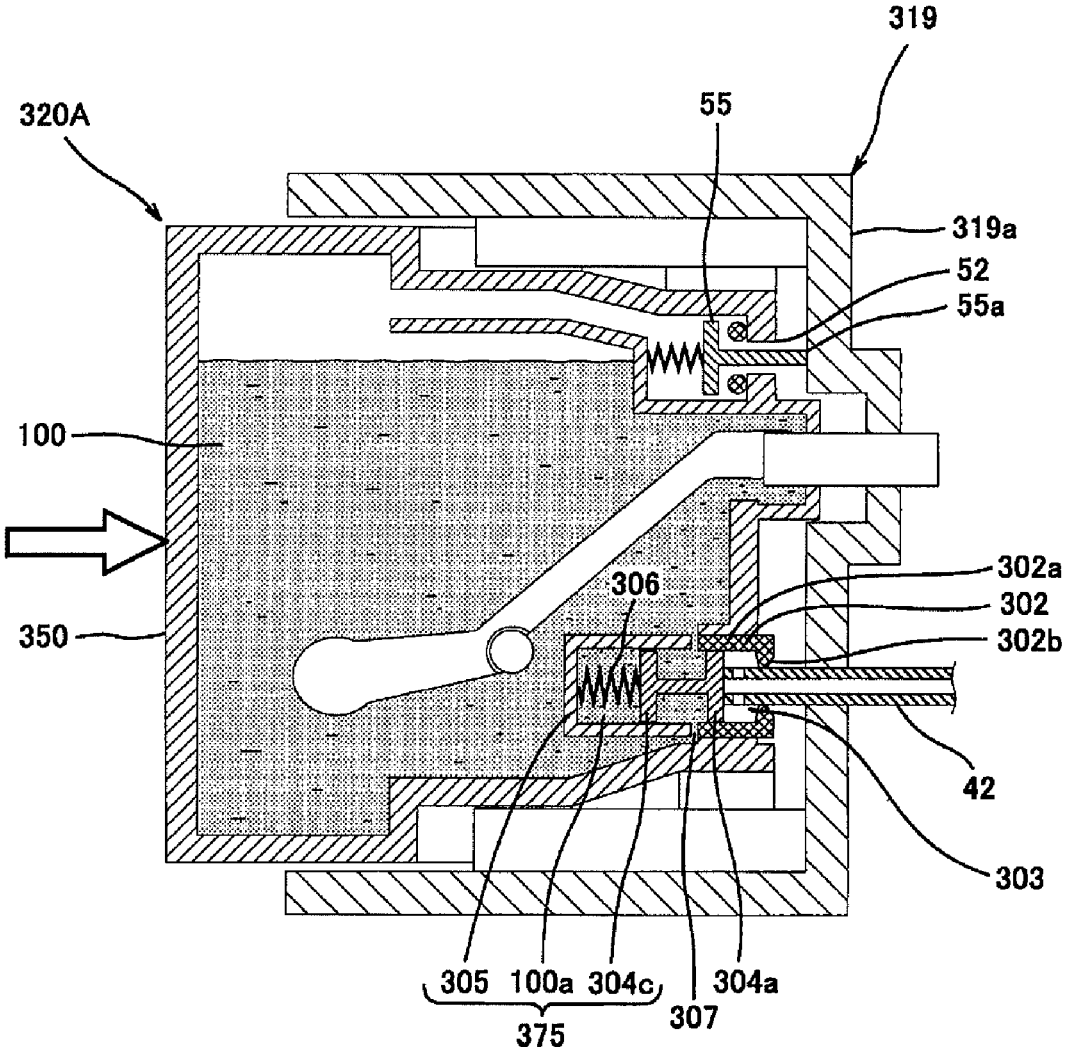
FIG. 16 is a cross-sectional view of the cartridge mounting portion and the ink cartridge of FIG. 15 during a mounting of the ink cartridge to the cartridge mounting portion.
Figure 17:
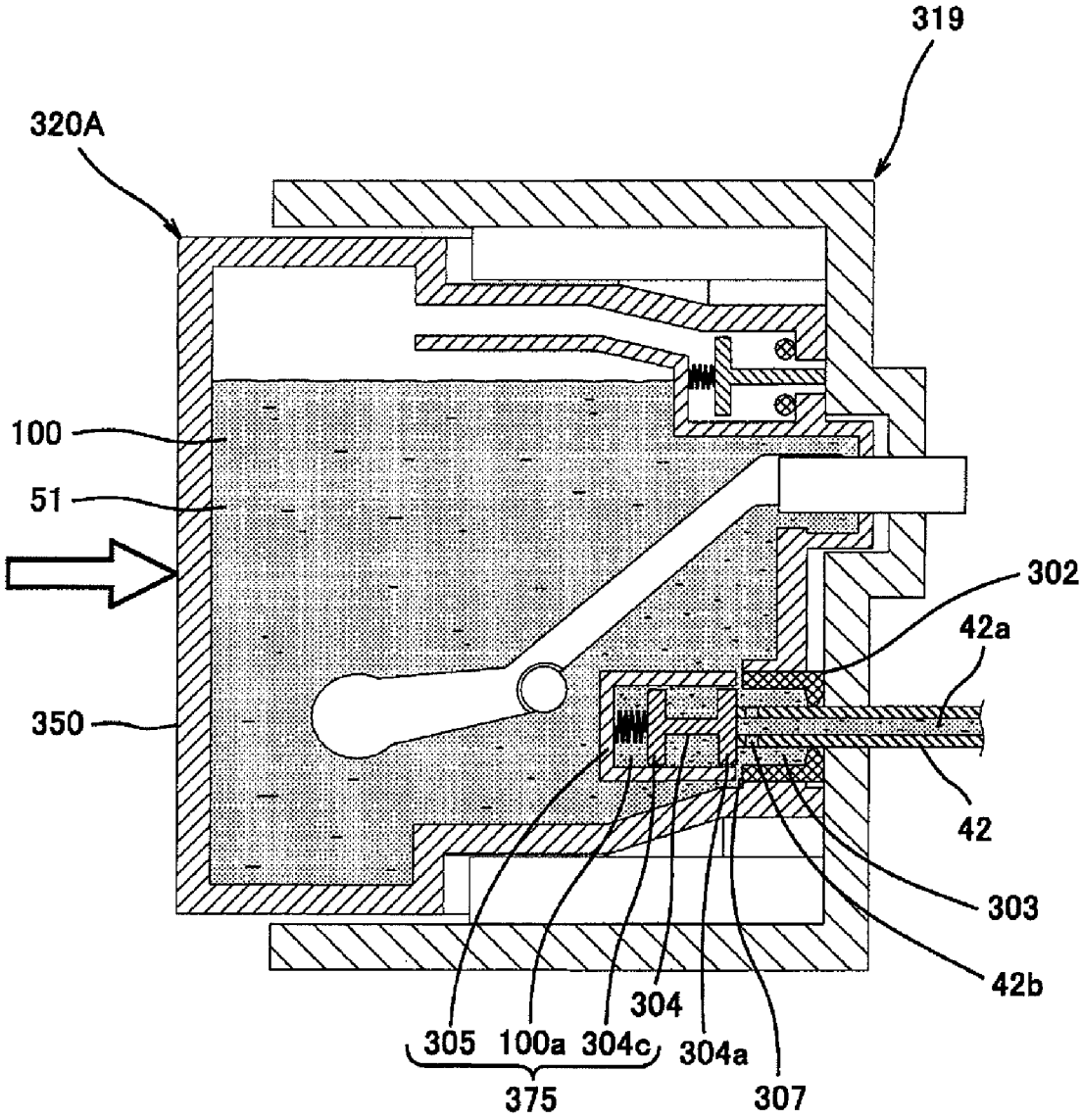
FIG. 17 is a cross-sectional view of the cartridge mounting portion and the ink cartridge of FIG. 15 when the mounting of the ink cartridge to the cartridge mounting portion is completed.

Referring to FIGS. 16 and 17, a mounting operation for mounting ink cartridge 320A to cartridge mounting portion 319 is described. Referring to FIG. 16, when ink cartridge 320A is inserted into cartridge mounting portion 319 by a user, the distal end of rod member 55*a* of air communication valve element 55 of ink cartridge 320A may be pushed away from annular sealing member 54 by end wall 319*a* of cartridge mounting portion 319 (i.e., air communication opening 52 may be uncovered). When this occurs, tube 42 may enter tubular sealing member 302 in a liquid-tight manner, while tightly contacting seal lip 302*b*, and tube 42 may push ink valve element portion 304*a*. As a result, piston portion 304*c*, which may be formed integrally with ink valve element portion 304*a*, may move in cylinder 305. Ink 100*a* present between piston portion 304*c* and cylinder 305 may be compressed and pressurized, causing a damping effect.

More specifically, cylinder 305 has a bottomed cylindrical shape, and the cross-sectional area of a gap between the outer peripheral surface of the piston portion 304*c* and the inner peripheral surface of cylinder 305 may be 1/300 to 1/400 of the cross-sectional area of the interior of cylinder 305, when viewed in a direction in which piston portion 304*c* moves in cylinder 305. Accordingly, ink 100*a* in cylinder 305 may be compressed and pressurized by piston portion 304*c*, causing a damping effect. Therefore, a damper 375 may comprise cylinder 305, piston portion 304*c*, and ink 100*a* present therebetween. A mounting force applied to ink cartridge 320A by the user when the user mounts ink cartridge 320A to cartridge mounting portion 319 may be opposed by damper 375. Moreover, the amount of reduction of the mounting speed of ink cartridge 320A may increase in proportion with an increase of the mounting speed.

When tube 42 enters ink supply opening 303 slowly, however, ink 100*a* in cylinder 305 may flow out smoothly via the gap between piston portion 304*c* and cylinder 305, and the mounting resistance may be small. Therefore, when the user inserts ink cartridge 320A into cartridge mounting portion 319 slowly, the user may feel little resistance.

Subsequently, referring to FIG. 17, tube 42 may push piston valve 304 inward, such that ink valve element portion 304*a* may pass gap 307 as it moves towards the bottom of cylinder 305. As a result, ink chamber 351 of ink cartridge 320A may be brought into communication with ink entry openings 42*b* of tube 42 (i.e., ink supply opening 303 may be uncovered). When ink supply opening 303 is uncovered in this manner, even if the user tries to mount ink cartridge 320A to cartridge mounting portion 319 quickly, the mounting speed may be reduced by damper 375 immediately before ink supply opening 303 is uncovered and ink chamber 315 is bought into communication with ink entry openings 42*b* of tube 42. Accordingly, there may be a sufficient amount of time between uncovering air communication opening 52 and uncovering ink supply opening 303 for the pressure in the ink chamber to equalize with the atmospheric pressure. Therefore, ink chamber 351 may be brought into communication with ink-jet head 35 after the pressure in ink chamber 351 reaches the atmospheric pressure or reaches a pressure close to the atmospheric pressure, thereby preventing entry of air from the nozzles into ink-jet head 35 due to, for example, generation of reverse flow of ink from ink-jet head 35 toward ink cartridge 320A. In this embodiment, a damper, e.g., damper 75 or liquid damper 94, in an area other than ink supply closing mechanism 371 may be eliminated, making it possible to reduce the size and/or complexity of ink cartridge 320A and cartridge mounting portion 319.

Although several embodiments of the invention have been described, the invention is not limited to the above-described embodiments. For example, recess 62 may be formed in end wall 19*a* of cartridge mounting portion 19, and protrusion 43 may be provided on case 50 of an ink cartridge. Liquid damper 94 may be provided on cartridge mounting portion 219, and pressing portion 96, which presses piston rod 91*a*, may be provided on casing 250 of ink cartridge 220A. In such an embodiment, ink cartridge 220A may be formed inexpensively. Also, when damper 75 or liquid 94 are provided independently from ink supply opening 64 and ink supply closing mechanism 71, ink supply closing mechanism 71 may not be configured selectively cover and uncover ink supply opening 64 by ink supply valve element 68. Instead, a film or covering, e.g., a sticker, which cannot be closed again after it is opened once by the penetration of tube 42 therethrough, may be used as ink supply closing mechanism 71. Although several embodiments described above are invention described in relation to an ink-jet printer, the invention may be applied to other devices, e.g., a liquid droplet discharging apparatus for manufacturing color filters of liquid crystal display devices by discharging liquid other than ink (for example, colored liquid), or an apparatus for forming electrical wirings by discharging conductive liquid.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid droplet discharging apparatus comprising:

a liquid cartridge comprising:

a liquid chamber configured to store liquid therein, the liquid chamber having a liquid supply opening and an air communication opening formed therethrough, wherein the liquid supply opening is configured to supply liquid from an interior of the liquid chamber to an exterior of the liquid chamber, and the air communication opening is configured to place the interior of the liquid chamber in communication with the exterior of the liquid chamber;

a first closing mechanism configured to selectively cover and uncover the liquid supply opening; and a second closing mechanism configured to selectively cover and uncover the air communication opening;

a cartridge mounting portion wherein the liquid cartridge is configured to be removably mounted to the cartridge mounting portion, the cartridge mounting portion having a liquid entry opening formed therethrough;

a damper configured to oppose at least a portion of a mounting force which the liquid cartridge receives during a mounting of the liquid cartridge to the cartridge mounting portion, wherein the damper comprises:

a recessed portion formed in one of a wall of the liquid cartridge and a wall of the cartridge mounting portion;

a protrusion positioned at the other one of the wall of the liquid cartridge and the wall of the cartridge mounting portion, wherein the protrusion is configured to be inserted into the recess; and wherein air between a distal end of the protrusion and a bottom of the recessed portion is pressurized when the protrusion is inserted into the recessed portion during the mounting of the liquid cartridge to the cartridge mounting portion, wherein the first closing mechanism is configured to uncover the liquid supply opening during the mounting of the liquid cartridge to the cartridge mounting portion, the second closing mechanism is configured to uncover the air communication opening during the mounting of the liquid cartridge to the cartridge mounting portion, and the first closing mechanism and the second closing mechanism are positioned such that the air communication opening is uncovered before the liquid supply opening is uncovered.

2. The liquid droplet discharging apparatus of claim 1, further comprising a liquid droplet discharging head comprising a nozzle configured to discharge liquid supplied from the liquid chamber via the liquid supply opening and the liquid entry opening, after the liquid cartridge is mounted to the cartridge mounting portion.

3. The liquid droplet discharging apparatus of claim 1, wherein the damper is configured to reduce a mounting speed at which the liquid cartridge is mounted to the cartridge mounting portion.

4. The liquid droplet discharging apparatus of claim 1, wherein the damper is configured to increase a force that opposes the mounting force in proportion to an increase of the mounting speed.

5. The liquid droplet discharging apparatus of claim 1, wherein the first closing mechanism comprises:

an annular sealing member having a center opening formed therethrough, wherein the annular sealing member is positioned adjacent to the liquid supply opening, such that the center opening is aligned with the liquid supply opening;

a valve element configured to selectively cover and uncover the center opening; and a spring configured to urge the valve element to close the center opening, wherein the recessed portion comprises a cylindrical-shaped inner surface of the annular sealing member and a bottom defined by an external surface of the valve element, the protrusion comprises a tube extending from the cartridge mounting portion, and the liquid entry opening is formed in an outer peripheral surface of the tube, and the pressurized air comprises air compressed between a distal end of the tube and the valve element, during the mounting of the liquid cartridge to the cartridge mounting portion.

6. The liquid droplet discharging apparatus of claim 1, wherein a cross-sectional area of a gap between an outer peripheral surface of the protrusion and an inner peripheral surface of the recessed portion is 1/300 to 1/400 of a cross-sectional area of an interior of the recessed portion.

7. A liquid droplet discharging apparatus comprising:

a liquid cartridge comprising:

a liquid chamber configured to store liquid therein, the liquid chamber having a liquid supply opening and an air communication opening formed therethrough, wherein the liquid supply opening is configured to supply liquid from an interior of the liquid chamber to an exterior of the liquid chamber, and the air communication opening is configured to place the interior of the liquid chamber in communication with the exterior of the liquid chamber;

a first closing mechanism configured to selectively cover and uncover the liquid supply opening; and a second closing mechanism configured to selectively cover and uncover the air communication opening;

a cartridge mounting portion wherein the liquid cartridge is configured to be removably mounted to the cartridge mounting portion, the cartridge mounting portion having a liquid entry opening formed therethrough;

a damper configured to oppose at least a portion of a mounting force which the liquid cartridge receives during a mounting of the liquid cartridge to the cartridge mounting portion, wherein the damper comprises:

a cylinder positioned at one of the liquid cartridge and the cartridge mounting portion;

a piston positioned in the cylinder; and a pressing portion positioned at the other one of the liquid cartridge and the cartridge mounting portion, wherein the pressing portion is configured to press the piston; and fluid stored in the cylinder, wherein an average pressure of the fluid stored in the cylinder increases relative to an average pressure of the liquid stored in the liquid chamber, when the liquid cartridge is mounted to the cartridge mounting portion, wherein the first closing mechanism is configured to uncover the liquid supply opening during the mounting of the liquid cartridge to the cartridge mounting portion, the second closing mechanism is configured to uncover the air communication opening during the mounting of the liquid cartridge to the cartridge mounting portion, and the first closing mechanism and the second closing mechanism are positioned such that the air communication opening is uncovered before the liquid supply opening is uncovered.

8. The liquid droplet discharging apparatus of claim 7, wherein the first closing mechanism comprises:

a tubular sealing member, wherein the liquid supply opening is formed through the tubular sealing member;

a valve element fitted in the tubular sealing member, and configured to selectively cover and uncover the liquid supply opening; and a spring configured to urge the valve element to cover the liquid supply opening, wherein the cylinder is positioned in the liquid chamber, the piston is integral with the valve element, the pressing portion comprises a tube extending from the cartridge mounting portion, and the liquid entry opening is formed inside the tube, the fluid comprises liquid which is compressed between the piston and the cylinder, during the mounting of the liquid cartridge to the cartridge mounting portion.

9. A liquid cartridge comprising:

a liquid chamber configured to store liquid therein, the liquid supply chamber having a liquid supply opening and an air communication opening, wherein the liquid supply opening is configured to supply liquid from an interior of the liquid chamber to an exterior of the liquid chamber, and the air communication opening is configured to place the interior of the liquid chamber in communication with the exterior of the liquid chamber;

a first closing mechanism configured to selectively cover and uncover the liquid supply opening; and a second closing mechanism configured to selectively cover and uncover the air communication opening;

a damper configured to oppose at least a portion of a force applied to the liquid cartridge during a mounting operation by creating a resistance, wherein the damper comprises at least one of:

a first recessed portion formed in a wall of the liquid cartridge, wherein the first recessed portion is configured to fit with a first protrusion of a liquid cartridge mounting portion of a liquid droplet discharging apparatus, and air between a distal end of the first protrusion and a bottom of the first recessed portion is pressurized when the first protrusion is inserted into the first recessed portion, during mounting of the liquid cartridge to the cartridge mounting portion; or a second protrusion positioned at the wall of the liquid cartridge, wherein the second protrusion is configured to fit with a second recessed portion of the liquid cartridge mounting portion of the liquid droplet discharging apparatus, and air between a distal end of the second protrusion and a bottom of the second recessed portion is pressurized when the second protrusion is inserted into the second recessed portion, during mounting of the liquid cartridge to the cartridge mounting portion.

10. The liquid cartridge of claim 9, wherein the damper is configured to increase the resistance in proportion to an increase of a speed at which the force is applied to the liquid cartridge.

11. The liquid cartridge of claim 9, wherein the first closing mechanism and the second closing mechanism are configured, such that the air communication opening is uncovered before the liquid supply opening is uncovered, during a mounting operation.

12. A liquid cartridge comprising:

a liquid chamber configured to store liquid therein, the liquid supply chamber having a liquid supply opening and an air communication opening, wherein the liquid supply opening is configured to supply liquid from an interior of the liquid chamber to an exterior of the liquid chamber, and the air communication opening is configured to place the interior of the liquid chamber in communication with the exterior of the liquid chamber;

a first closing mechanism configured to selectively cover and uncover the liquid supply opening; and a second closing mechanism configured to selectively cover and uncover the air communication opening;

a damper configured to oppose at least a portion of a force applied to the liquid cartridge during a mounting operation by creating a resistance, wherein the damper comprises:

a cylinder;

a piston positioned in the cylinder; and fluid stored in the cylinder, wherein an average pressure of the fluid stored in the cylinder increases relative to an average pressure of the liquid stored in the liquid chamber when the piston receives the force.

13. The liquid droplet discharging apparatus of claim 12, wherein the first closing mechanism comprises:

a tubular sealing member, wherein the liquid supply opening is formed through the tubular sealing member;

a valve element fitted in the tubular sealing member, wherein the valve element is configured to selectively cover and uncover the liquid supply opening; and a spring configured to urge the valve element to cover the liquid supply opening, wherein the cylinder is positioned in the liquid chamber, the piston is integral with the valve element, and the fluid comprises liquid which is compressed between the piston and the cylinder, during the mounting operation.

14. The liquid droplet discharging apparatus of claim 12, wherein the cylinder is formed in the liquid cartridge; and wherein a pressing portion of a cartridge mounting portion of a liquid droplet discharging apparatus is configured to press the piston, and the average pressure of the fluid stored in the cylinder increases relative to the average pressure of the liquid stored in the liquid chamber, during mounting of the liquid cartridge to the cartridge mounting portion.

* * * * *